US007347168B2

(12) United States Patent
Reckels et al.

(10) Patent No.: US 7,347,168 B2
(45) Date of Patent: Mar. 25, 2008

(54) PREDICTIVE AUXILIARY LOAD MANAGEMENT (PALM) CONTROL APPARATUS AND METHOD

(75) Inventors: Dieter Reckels, Portland, OR (US); Cristin Paun, Portland, OR (US); Shiva Duraiswamy, Portland, OR (US); Nitin Magoo, Carrboro, NC (US)

(73) Assignee: Freightliner LLC, Portland, OR (US)

( * ) Notice: Subject to any disclaimer, the term of this patent is extended or adjusted under 35 U.S.C. 154(b) by 0 days.

(21) Appl. No.: 11/513,678

(22) Filed: Aug. 30, 2006

(65) Prior Publication Data

US 2007/0261648 A1 Nov. 15, 2007

Related U.S. Application Data

(60) Provisional application No. 60/800,634, filed on May 15, 2006.

(51) Int. Cl.
*F01P 7/02* (2006.01)
*F01P 5/10* (2006.01)
*G06F 19/00* (2006.01)

(52) U.S. Cl. ..... 123/41.11; 123/41.44; 701/36

(58) Field of Classification Search ..... 123/41.11, 123/41.12, 41.44, 41.45, 41.46, 41.47, 41.48, 123/41.49; 701/36
See application file for complete search history.

(56) References Cited

U.S. PATENT DOCUMENTS 4,922,428 A 5/1990 Takahashi
5,094,213 A 3/1992 Dudek et al.
5,293,553 A 3/1994 Dudek et al.
5,546,311 A 8/1996 Sekine
5,713,428 A 2/1998 Linden et al.
5,774,820 A 6/1998 Linden et al.
5,832,400 A 11/1998 Takahashi et al.
5,995,895 A 11/1999 Watt et al.
6,076,036 A 6/2000 Price et al.
6,167,357 A 12/2000 Zhu et al.
6,249,723 B1 6/2001 Lutz
6,278,931 B1 8/2001 Crawford et al.
6,349,253 B1 2/2002 Bellinger
6,353,785 B1 3/2002 Shuman et al.
6,370,451 B2 4/2002 Lutz
6,370,472 B1 4/2002 Fosseen (Continued)

FOREIGN PATENT DOCUMENTS

CA 2240057 2/2001

(Continued)

OTHER PUBLICATIONS

JP7117524 to Hirotoshi, et al. published May 9, 1995. With English language abstract.

(Continued)

*Primary Examiner*—Noah P. Kamen
(74) *Attorney, Agent, or Firm*—Klarquist Sparkman LLP

(57) ABSTRACT

An improved vehicle cooling system is disclosed having the capability of controlling various thermal components of the system to effectively control the heating and cooling of an engine of the vehicle based on instantaneous vehicle and ambient conditions and also based upon predictive conditions. These predictive conditions can include information about the upcoming terrain of the route along which the vehicle will travel.

29 Claims, 7 Drawing Sheets

U.S. PATENT DOCUMENTS

| | | | | |
|---|---|---|---|---|
| 6,374,173 | B1 | 4/2002 | Ehlbeck | |
| 6,387,011 | B1 | 5/2002 | Bellinger | |
| 6,436,005 | B1 | 8/2002 | Bellinger | |
| 6,438,510 | B2 | 8/2002 | Zhu et al. | |
| 6,470,257 | B1 | 10/2002 | Seto | |
| 6,546,329 | B2 | 4/2003 | Bellinger | |
| 6,577,937 | B1 | 6/2003 | Shuman et al. | |
| 6,591,174 | B2 * | 7/2003 | Chung et al. | 701/36 |
| 6,675,081 | B2 | 1/2004 | Shuman et al. | |
| 6,819,995 | B2 | 11/2004 | Bellinger | |
| 6,836,719 | B2 | 12/2004 | Andersson et al. | |
| 6,839,619 | B2 | 1/2005 | Bellinger | |
| 6,944,532 | B2 | 9/2005 | Bellinger | |
| 6,990,401 | B2 | 1/2006 | Neiss | |
| 7,225,073 | B2 | 5/2007 | Hedman et al. | |
| 2003/0216847 | A1 | 11/2003 | Bellinger | |
| 2003/0221886 | A1 | 12/2003 | Petrie, Jr. | |
| 2004/0002806 | A1 | 1/2004 | Bellinger | |
| 2004/0068359 | A1 | 4/2004 | Neiss et al. | |
| 2004/0167705 | A1 | 8/2004 | Lingman et al. | |
| 2005/0085966 | A1 | 4/2005 | Eriksson et al. | |
| 2006/0095178 | A1 | 5/2006 | Guilfoyle et al. | |
| 2006/0102399 | A1 | 5/2006 | Guilfoyle et al. | |
| 2007/0067087 | A1 | 3/2007 | Ohshima | |
| 2007/0112475 | A1 | 5/2007 | Koebler et al. | |

FOREIGN PATENT DOCUMENTS

| | | |
|---|---|---|
| EP | 1302356 | 4/2003 |
| WO | WO 03/041987 | 5/2003 |
| WO | WO2006/107267 | 3/2006 |

OTHER PUBLICATIONS

JP7117524 to Hirotoshi, et al. published May 9, 1995. Machine translation to English language.

* cited by examiner

PREDICTIVE AUXILIARY LOAD MANAGEMENT (PALM) CONTROL APPARATUS AND METHOD

CROSS-REFERENCE TO RELATED APPLICATION

This application claims the benefit of U.S. Provisional Application Ser. No. 60/800,634, filed May 15, 2006, which is incorporated by reference herein.

TECHNICAL FIELD

The disclosed technology relates to controlling the operation of vehicle components that add and remove heat from a thermal cooling system of a vehicle to enhance the overall performance of the vehicle.

BACKGROUND

Known coolant pumps and cooling fans often run directly off an engine shaft by means of a gear mechanism or a belt drive system, and therefore maintain a flow rate that is dependent only on the engine RPM. As a result, in such cases the coolant pump provides a coolant flow rate that is a function of the engine RPM and similarly the cooling fan maintains an airflow rate which also is a function of the engine RPM. Such traditional cooling systems have been designed on the premise of providing adequate cooling to the engine in the worst-case scenarios, i.e., a fully-loaded vehicle running at peak power engine speed and high ambient temperatures. However, these mechanically driven systems do not have the ability or the intelligence to alter their operating strategy and adjust to the actual cooling requirement of the engine in a variety of other operating situations. Thus, such known cooling systems do not provide optimum cooling to the engine at all times, but end up either under-cooling or over-cooling the engine during various on-the-road scenarios. This behavior reduces the engine efficiency, leading to higher fuel consumption and also adds auxiliary loads to the engine at times when the engine does not have any spare power.

Variable flow electric coolant pumps have recently been introduced. These electric coolant pumps respond to control signals to vary the rate at which coolant flows in the cooling circuit.

OVERVIEW

In accordance with one aspect of the disclosure, one or more components that impact the heating and cooling of an engine of a vehicle are desirably operated other than being driven by a gear or drive link to the engine. As a result, such components can be controlled regardless of the revolutions per minute (RPM) at which the engine is operated. This allows the selected components to be operated in a manner that more effectively controls the temperature of the engine. For example, the engine can be operated at or near its maximum operating temperature for longer periods of time for more efficient operation and fuel savings.

As another aspect of this disclosure, future engine heating and cooling requirements can be predicted based, for example, in part on knowledge about elevation changes in the upcoming terrain that the vehicle will encounter. As a result, vehicle heating and cooling components can be operated in a manner that anticipates future variations in engine heating and cooling arising from changes in the terrain.

As yet another aspect of the disclosure, future engine heating and cooling requirements can be predicted based, for example, in part on knowledge about environmental conditions, such as upcoming traffic or roadwork (e.g., slow downs) that the vehicle will encounter. As a result, vehicle heating and cooling components can be operated in a manner that anticipates future changes in traffic, roadwork or other environmental conditions.

As another aspect of the disclosure, thermal components of a vehicle can be operated so as to optimize a cost function.

In accordance with one aspect of an embodiment, knowledge of upcoming hills can be utilized to control components to increase the cooling of liquid coolant in a vehicle thermal cooling system prior to encountering such hills to thereby minimize the operation of heavy power utilizing components, such as an engine fan, at times when the power is particularly needed, such as when the vehicle is climbing a hill.

As another aspect, knowledge of the terrain can be used, for example, in controlling engine cooling components, such as a fan, to selectively delay their operation when the vehicle is, for example, about to approach the crest of a hill under conditions where the temperature of liquid coolant will remain below a maximum allowable coolant temperature without the fan being turned on and even though the AC activation temperature will exceed a set point that would otherwise result in the fan being turned on in absence of the terrain information.

In one approach, a typical land vehicle can be viewed as having a mechanical power train system and a thermal cooling system. The mechanical power train system typically comprises the engine and drive train. The thermal cooling system typically comprises the engine (which heats up as the engine is operated), a coolant thermostat, a radiator, a coolant pump, an engine fan and an oil cooler. Other components that add or remove heat from liquid coolant circulating in the thermal cooling system can also be viewed as part of such a vehicle thermal cooling system. For example, an engine compression brake or retarder, with a jake brake being one specific example, can add heat to the coolant when operated. As another example, in newer engines, exhaust gas recirculation (EGR) systems can be utilized to cool exhaust gases for injection as part of the charge air to the engine. EGR cooling, to the extent liquid coolant circulating in the thermal cooling system is used to cool these recirculating exhaust gases, add to heat in the system. As another example, vehicle front closing mechanisms, such as shutters, can be utilized to close off a grille or other bumper and vehicle openings in whole or in part. When entirely closed, ambient air flow through the grille and radiator is reduced, thereby increasing heat retention by the system. Also, components such as a charge air cooler and air conditioning condenser are often positioned to intercept air flowing through the grille which can, for example, add heat to the air which then impacts the extent such air removes heat when impacting a vehicle radiator. Also, a cab heater and/or sleeper compartment or bunk heater, when activated, can deliver heat from liquid coolant to the cab or other interior compartments of a vehicle, constituting another source of heat transfer.

As mentioned above, by replacing one or more of the components (other than the engine) included in the thermal cooling system with controllable counterparts, additional control of the thermal conditions of the engine of the land vehicle can be achieved. For example, components can be used that are controlled other than being directly driven by the engine. As specific examples, one or more electric powered and electrically controlled components can be used, such as an electric coolant pump, an electric coolant thermostat, an electric oil thermostat, an electric fan, electric motor controlled shutters, an electric cab heater valve, and an electric cab bunk heater valve. These components can be controlled based on instantaneous vehicle operating conditions (including environmental conditions) or in a predictive manner based, for example, on future elevation information along various points along which the vehicle will be traveling.

Desirable aspects of various embodiments of the disclosure achieve one or more of the following advantages, and most desirably all of such advantages.

1. To utilize future elevation information, as such as from a 3-D map, and current position information (such as derived from a global positioning satellite and vehicle speed or from an initial maneuvering unit (IMU) that computes a new position from a last known (e.g., GPS determined) position), to improve thermal energy management and, as a result, to save fuel.

2. To minimize the energy consumed by engine auxiliaries, such as an engine fan and coolant pump.

3. To reduce the duration of engine cold start by rapidly bringing the engine to desired thermal operating conditions (e.g., by routing coolant in a bypass loop when the engine is cold and by initially reducing coolant flow rates through the engine to a minimum flow rate as the engine warms up). The duration of engine cold start can also be reduced by closing air flow passageways leading to an engine compartment, such as through a vehicle grill. A shutter or other closure mechanism can be used to accomplish this.

4. To optimize the engine thermal behavior by maintaining a high engine temperature even during low-load operating conditions.

5. To maintain engine temperatures and coolant temperatures below maximum levels, such as specified by engine manufacturers, at all times.

6. To reduce internal friction due to oil viscosity and to provide lubricity improvements arising from enhanced engine oil temperature control.

7. To minimize overshoot coolant temperatures at engine startup, and to achieve more stable non-oscillating coolant temperature behaviors during operation of the vehicle.

8. To provide a system which enhances the achievability of desirable cab temperatures.

In accordance with an aspect of an embodiment, in the absence of vehicle position information, in the absence of operation of the vehicle under predictive conditions (e.g., cruise control is not being used and/or a driver predictive model is not available for the driver), and/or in the absence of future elevation information concerning the route being traveled, the PALM system can control the thermal cooling system components based on instantaneous vehicle operating conditions.

In accordance with yet another aspect, of an embodiment, an optimized desired engine temperature profile is computed for a given load profile. The optimized engine temperature profile can be established to, for example, minimize fuel and improve thermal efficiency. In a particularly desirable approach, the optimized engine temperature profile is mathematically determined to optimize a cost function.

In accordance with a specific aspect of one embodiment, in the absence of a change in elevation along the route, the PALM system can cause the vehicle to operate so as to maintain a maximum allowable engine temperature to thereby improve engine efficiency.

As one specific approach relating to the use of terrain information, PALM establishes a look-ahead window (prediction horizon) and uses 3-D maps and information about the present vehicle position to establish the grade across the positions in the window. Based in part on the grade information, and starting from the current position and also based on current environmental and vehicle conditions, in a desirable approach the PALM system determines the engine heat rejected as a function across all positions in the window. For example, the engine heat rejection can be determined as a function of the engine speed and engine torque. The PALM system then can determine desired optimized engine temperatures and control inputs for the various thermal impacting components to meet the control system objectives. The control inputs can then be set as commands to components, e.g., to electrically operating components, of the vehicle thermal cooling system.

In accordance with a desirable embodiment of the PALM system, the system can, in one aspect of an embodiment, ensure that engine temperatures are at a high value at the top of a hill, without exceeding the maximum coolant temperature value, because, when the vehicle then travels down the hill adequate cooling is achieved.

In accordance with yet another aspect of one embodiment, desirably the PALM system of this embodiment ensures that the engine temperature is at a low value at the foot of a hill to in effect pre-cool the engine prior to the vehicle climbing a hill. The low value being lower than the value achieved merely by reduced heating of the vehicle when traveling downhill. For example, a cooling pump can be operated at a high rate, and a fan can potentially operate, when the vehicle is traveling downhill even through coolant temperatures are below the levels that would cause the operation the coolant pump at a high rate or operation of the fan in the absence of knowledge concerning the upcoming hill. In as much as engines generate more heat when climbing a hill, this pre-cooling minimizes the possibility of coolant temperatures reaching high values that would require additional cooling, such as by turning on a fan, when the vehicle climbs the hill.

In accordance with a specific aspect of an embodiment, the PALM system desirably utilizes a cost function approach, with individual cost functions, that is minimized, for example by minimizing the sum of such cost functions.

The disclosure is directed toward novel and non-obvious features and method acts both alone and in various combinations and sub-combinations of one another. It is not a requirement that all features disclosed herein be included within a thermal control system or that all advantages disclosed herein are met by such a system.

BRIEF DESCRIPTION OF THE DRAWINGS

(FIGS. 6-8 are hypothetical examples).

DETAILED DESCRIPTION

Figure 1:
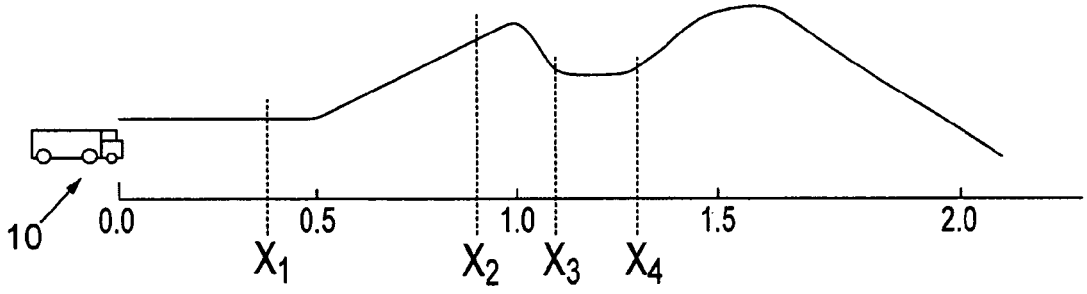
FIG. 1 illustrates an exemplary profile of a section of a route being traveled by a land vehicle, such as a truck.

An engine cooling system provides cooling to various parts of a vehicle engine in order to maintain the engine within a safe operating temperature range. The fuel combustion process is highly exothermic, resulting in the release of substantial energy. A significant portion of that energy is transferred to the combustion chamber walls of the engine as heat. This heat has to be constantly removed from the engine so that the engine material temperatures do not approach or exceed the temperature at which material fracture occurs. This task of heat removal is accomplished in an internal combustion engine by an engine cooling system, which transfers energy away from the engine and releases it, such as to the space within the engine compartment and to the external environment. A thermal cooling system comprises the coolant fluid (an example being a water and glycol liquid mixture), coolant pump, coolant thermostat, cooling fan, radiator and also a conduit system for circulating the coolant. The cooling system can also include oil coolers, an oil thermostat, and other components, such as explained in the example of FIG. 3 below.

Fuel economy can be improved by electronically controlling a coolant pump and cooling fan operation depending on factors such as the engine and coolant temperatures. In addition, by using predictive capabilities to acquire knowledge of the oncoming road grade, future engine cooling requirements can be estimated and a control strategy can be devised to achieve desirable goals, such as to minimize the fuel consumption over the entire route traveled by the vehicle. Information on upcoming traffic problems can also be used in embodiments as a factor considered in the determination of future cooling requirements.

In general, given the geographic position of a vehicle along a route (latitude and longitude from, for example, position signals provided to a vehicle mounted Global Positioning Satellite (GPS) receiver), and having a digital map of the route including precise elevation information, and with the vehicle being operated under predictive conditions, the need for operation of auxiliary components driven by an engine over a next section of the route can be predicted. Predictive conditions include, for example, when a vehicle cruise control is in use. As another example, predictive conditions can also include vehicle operation by a driver having a known drive profile. As yet another example, predictive conditions can include traffic conditions, such as an upcoming construction zone along flat terrain with a tightly controlled speed limit or an upcoming traffic slowdown. Current or real time traffic conditions along a route can be delivered to the vehicle for use by the system in any suitable manner, such as via a satellite or other wireless transmissions. The operation of these auxiliary components can be controlled based on these predictions to, for example, achieve lower fuel consumption or to reduce coolant temperature varieties (e.g., to a range of from 85°-95° C. instead of a wider more typical set point controlled range of 50°-95° C., for a 95° C. maximum coolant temperature. The maximum coolant temperature is typically set by an engine manufacturer, with 92° to 95° C. being examples. In the event elevation information is not available for a route or route segment, or the vehicle is not being operated under predictive conditions, instantaneous vehicle conditions can be used to control the auxiliary components.

FIG. 1 illustrates an exemplary elevation profile along a route to be traversed by a vehicle. The vehicle 10 is illustrated schematically as a truck on the route at a reference location indicated at 0.0 for convenience. The reference location simply indicates the current or instantaneous position (e.g., latitude and longitude) of the vehicle along the route. The instantaneous position can be obtained utilizing GPS technology with, for example, a GPS receiver being located on the truck to receive a GPS signal used to provide the latitude and longitude position.

Figure 2:
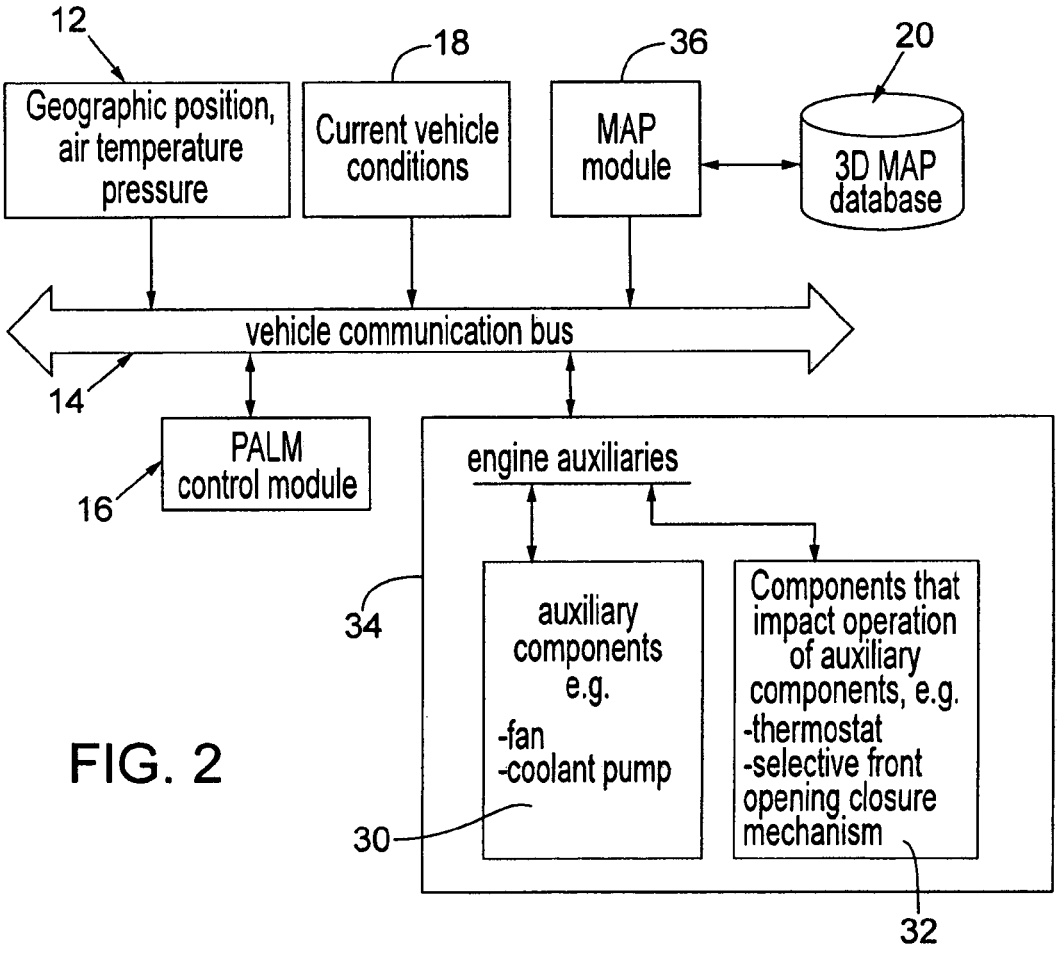
FIG. 2 is a block diagram of one embodiment of a PALM control module included within a land vehicle, together with various components of the vehicle communicating with the control module by way of a vehicle communication databus.

FIG. 2 illustrates a block 12 that can comprise the GPS receiver to provide geographic position information. Position signals can be communicated from block 12 to a conventional vehicle communications bus 14 and from the bus to a predictive auxiliary load management (PALM) control module 16 that can control the operation of the engine auxiliaries based on calculations from input information.

A three dimensional map database 20 can be provided that can store longitude and latitude information as well as precisely determined elevation information corresponding to the longitude and latitude location. Thus, assuming the information is available for a given route, or route segment, the 3D database can contain data that includes elevation information corresponding to contour changes along the route correlated to the position along the route. The map database can be generated in any convenient manner. For example, a truck or other vehicle with a pressure sensor can be driven over a route with data being sampled (e.g., every 40 milliseconds) to provide accurate elevation information. More frequent samples can be taken, with less distance between data points, when elevation is changing and less frequent samples can be taken when elevation is relatively unchanged. An exemplary elevation profile provides accurate elevation information within one percent. The test vehicle can be driven over the route multiple times with the results being averaged or otherwise combined to provide more accurate elevation information for the route. Alternatively, the data can be gathered by one or more trucks traveling over a given route. When a desired number of trips have occurred over the given route, the data may be combined, such as by averaging, to create the route contour. In addition, although GPS supplied elevation information is insufficiently accurate at this time, eventually GPS generated location data and elevation profiles may become accurate enough for use by the system.

With reference to FIG. 2, the exemplary block 12 comprises a GPS receiver that receives GPS signals from which the latitude and longitude of the instantaneous vehicle position can be obtained or computed. In addition, block 12 can also comprise an air temperature sensor and pressure sensor for respectively determining the ambient air temperature outside the vehicle at the instantaneous vehicle location and the air pressure at such location. Ambient air temperature can be used in calculating anticipated cooling requirements of the engine because more engine cooling is typically required at higher ambient air temperatures. In addition, ambient pressure measurements provide an indicator of the density of air and can impact heat transfer from the engine.

These signals can be communicated to a vehicle databus 14. The PALM 16 receives these signals from the databus for use in calculating the anticipated operation of engine auxiliaries, such as cooling components of the engine. Signals from sensors for other input devices corresponding to a variety of current vehicle conditions, indicated at block 18, are communicated to the vehicle communication bus and thus are also available to PALM control module 16. A list of exemplary instantaneous vehicle conditions comprises fuel rate, engine torque, throttle status, wheel speed, engine rpm, gear clutch status, engine brake level, retarder [additional optional brake] level, service brake level, coolant temperature, steering status, engine fan status, air conditioning (AC) status and cabin status (e.g., cab and sleeper temperature).

Figure 3:
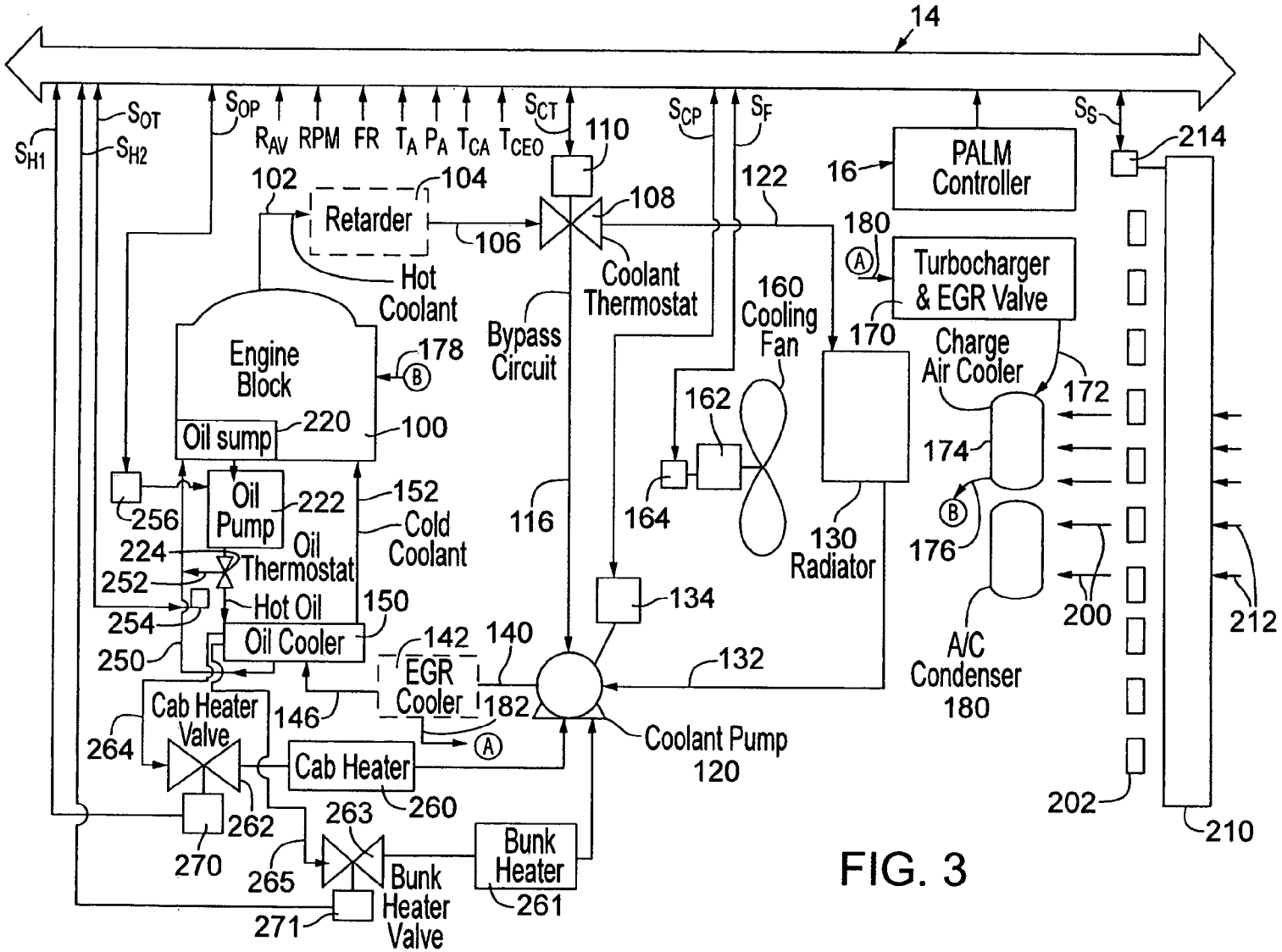
FIG. 3 is a block diagram of an exemplary thermal cooling system for a land vehicle driven by an engine.

Engine auxiliaries can include devices that are directly connected to or coupled to the engine shaft and that take power away from the engine such as an engine driven fan and gear driven cooling pump. Electrically controlled components are alternatives to one or more of these engine driven components (see block 30 in FIG. 2). Also desirably included in this engine auxiliary category are components that impact the cooling of the vehicle, such as shown in block 32 of FIG. 2. For example, a controllable thermostat can be opened to permit the flow of coolant through the engine cooling system, thereby effecting whether a cooling fan needs to be turned on. The term thermal components comprises components that add heat to or remove heat from liquid coolant circulating in a cooling system of the vehicle. Thermal components also can comprise non-passive components that operate to assist in the removal of heat from or retention of heat by the vehicle cooling system. FIG. 3, described below, illustrates exemplary thermal components of a vehicle. In addition, the reference to a selective front opening closure mechanism or shutter refers to, for example, a device that is operable to partially or entirely close off grille and/or bumper openings of a vehicle when cooling requirements are reduced. In contrast, such openings can be partially or fully opened to assist in cooling of the vehicle by permitting maximum air flow through such openings to the engine compartment of the vehicle when greater engine cooling is required.

Signals corresponding to the operating condition of these engine auxiliaries 34 are desirably provided to vehicle communication bus 14 and are thus available to the PALM control module. In addition, these various components can be controlled by signals from the PALM control module (e.g., whether the coolant thermostat is opened, the selective front opening closure mechanisms being open or closed, the fan being turned on or off, the coolant pump being operated and controlled to circulate more or less coolant, etc.). In the case of an electric coolant pump with a variable flow rate, PALM can desirably control the RPM of the electric coolant pump to vary the flow rate from a minimum coolant flow rate to a maximum flow rate. As an example, and not a requirement, one suitable electrical variable flow rate coolant pump is produced by Engineered Machine Products, Inc. of Escanaba, Mich.

The map module 36 in FIG. 2 can be provided with knowledge of the instantaneous position of the vehicle (from signals on the data bus or from a map request from PALM) and can fetch data from the 3D MAP database corresponding to an upcoming section of a route or expected route (e.g., the next two to five miles). This upcoming route section can be termed a prediction horizon. If the GPS location or position signal indicates the vehicle has deviated from the expected route section (e.g., taken a freeway exit), a new expected route section can be selected as the next prediction horizon or window. Respective windows can be opened to correspond to successive or otherwise selected route windows such that route information processing can be accomplished simultaneously in more than one such window.

The window or route segments need not be a constant length, although this can be desirable. For example, when traveling over terrain known to be substantially flat (e.g., portions of Nebraska), PALM can select windows of extended length. Alternatively, instantaneous conditions can be used for control of the thermal components in such cases rather than using PALM calculations for control. The PALM control module can then predict the anticipated engine cooling requirements that will arise as the vehicle traverses this upcoming section of the route and can compute a set of control signals to alter the control of the engine auxiliaries to improve the performance of the vehicle, such as to increase the fuel efficiency or to maintain the engine temperature at a high level to enhance engine performance. Desirably, the map module 36 retrieves upcoming prediction window as data related to the just traversed prediction window is discarded so that calculations can be made rapidly on an ongoing basis.

A number of examples of how the PALM system can operate are described below. For example, assume the vehicle 10 reaches location x1 of FIG. 1. Also assume that the instantaneous vehicle conditions would indicate that no additional cooling is required. Thus, the coolant thermostat can, for example be closed (coolant temperature is below a set point) and a grille closure mechanism is closed. In the absence of the predictive element of the PALM system, the vehicle would continue to operate under this mode as it reaches the next hill (it starts at roughly the 0.5 mile point in FIG. 1). As the vehicle goes up the hill, increased cooling is required with the thermostat being opened, for example, the coolant pump being operated at an increased rate; and the vehicle fan turning on.

In contrast, in situations where elevation data is known for an upcoming section of a route, because the PALM system knows that a hill will soon be reached, at $X_1$ (or some other location prior to the hill), the coolant thermostat can be opened and the grille cover opened to increase cooling before the hill is reached. If sufficient pre-cooling is achieved, the possibility exists of not having to operate the coolant pump at high speeds or, if the cooling pump is operated at high speeds, in contrast to a minimum rate, not having to turn on the vehicle cooling fan. In a heavy duty truck, a belt driven cooling fan can use up to about ten to fifteen percent of the engine power when on. In contrast, a gear driven cooling pump driven by an engine drive shaft or by an alternator, can utilize two to three percent of the engine power. Thus, it is desirable to pre-cool the engine to minimize the possibility of the fan turning on or to limit the amount of time the fan is on. In the case of an electrically controlled variable speed coolant pump and an electric cooling fan, it can be desirable to minimize the rate of operation of the coolant pump and to minimize the operation of a fan, for example to save the energy required to operate the pump at high rates and to operate the fan.

When the vehicle reaches location $X_2$, instantaneous conditions may indicate that the cooling fan should be turned on. However, because the contour of the route is known in this example, and therefore the fact that the vehicle is almost at the crest of the hill is known, PALM can control the system to prevent the fan from turning on as cooling will increase without the fan as the vehicle crests the hill and travels downhill.

Similarly, at location $X_3$ because the upcoming contour is known in this example, even though the vehicle is descending, the PALM system recognizes that a hill is approaching. Therefore, at $X_3$ steps can be taken to increase the pre-cooling of the engine in advance of the hill (e.g., the thermostat can be open, grille closure mechanisms can be open). Similarly, at $X_4$, PALM recognizes that a significant portion of the hill remains and can control the cooling pump to increase the flow of cooling fluid, thereby deferring or delaying the turning on of the fan.

As another example, the PALM controller can calculate the future engine and cooling system requirements for the upcoming prediction horizon or window. Auxiliaries can be intelligently controlled to maintain an optimal engine temperature along the route at which the engine operates at maximum thermal efficiency. Some exemplary scenarios are as follows:

- Knowing an uphill is coming ahead, the controller can increase the cooling pump speed of a variable speed coolant pump before the uphill section to enhance cooling of the coolant so as to avoid or minimize the turning on of the controlled engine cooling fan
- Knowing a downhill is coming ahead and the vehicle on the downhill portion will be accelerated, so the cooling will be more intense than necessary, the controller can reduce the speed of the controlled coolant pump. The commands to the controlled coolant pump are desirably coordinated with commands to a controlled coolant valve and controlled front grille blinds.
- The engine cooling fan can be triggered by operation of a vehicle AC system. This can happen when approaching the top of an uphill section. However, by knowing the distance and time required to reach the top of the uphill section, the controller can determine that the operation of the fan can be delayed (e.g., because cab and bunk temperature are not expected to become uncomfortable before the top of the hill is reached) even though AC operation commands indicate the fan should be turned on.

The engine cooling requirements for achieving a desired engine temperature profile along a route are desirably translated by the controller into command signals to the controlled components, such as the engine cooling fan, controlled cooling valve, controlled cooling pump and other controlled thermal system cooling components. The commands are sent to the controlled auxiliaries, such as via the vehicle communication bus, via hardwired communication lines, or by wireless communication.

A computer model has been developed to simulate the combustion and heat exchange processes in a turbocharged direct-injection diesel engine. One can estimate the engine heat rejection based on a model for the energy release process of combustion. The coolant flow through the engine block can be modeled to calculate the heat removed from the engine.

Due to a constantly changing road profile and vehicle power requirements for any actual on-the-road situation, the engine operating conditions and temperatures are always in a transient state and never reach a steady state value. To accurately simulate such dynamic situations, it is desirable that the entire coolant flow circuit comprising the radiator, pump, coolant thermostat and hoses be modeled. Since, the coolant ultimately transfers the heat to the engine compartment or ambient air, the model can also include the airflow circuit comprising the cooling fan, charge air cooler, AC condenser and grille assembly, grille closing (shutter) assembly, if any, as well as other components.

The forces opposing the motion of a vehicle on a flat road can be broadly classified into two categories: aerodynamic resistance, and friction resistance. For the vehicle to maintain its motion, the engine must provide sufficient power to overcome these forces. When a transmission is engaged, the engine RPM can be directly proportional to the vehicle speed with the power train overall ratio being the constant of proportionality. In a directly driven cooling system (e.g., a coolant pump driven by a gear from an engine drive shaft), the cooling system operation is directly linked to the engine RPM. The higher the engine RPM, the greater the coolant flow rate generated by the pump and the greater the airflow rate generated by a direct driven cooling fan when switched on. Consequently, in such an approach, at a higher vehicle velocity, the amount of cooling provided to the engine is greater.

Consider a scenario where the vehicle is traversing a positive road grade. The weight of the vehicle adds another force opposing the vehicle motion, and this is commonly termed as road grade resistance. Under such a situation, the engine has to generate a higher power in order to maintain vehicle motion. This causes the engine temperatures to rise, which can result in the cooling fan being turned on. A direct drive cooling fan can consume on average 10% to 15% of the engine power. In effect, when the fan turns on, the cooling system uses significant engine power at a time when that power is needed to maintain the vehicle speed. In such a situation, the vehicle may not be able to maintain its speed and can slow down.

The above analysis demonstrates how the operation of the cooling system at a critical time can affect the engine output power available to drive the vehicle. In a direct drive cooling system, as explained above, both the coolant and air flow rates can be directly proportional to the engine RPM. For the case where the vehicle is traveling uphill, since the RPM is lowered, this can mean that the coolant and air flow rates would be reduced. Therefore, in spite of the fact that the engine temperature is now higher as compared to the engine temperature when the vehicle is on a flat road, the cooling being provided to the engine has been reduced. Even if the RPM were to be maintained at the same value as that on the flat road, the cooling provided to the engine while going uphill would at best be equal to the cooling provided on the flat road. If one assumes that the cooling provided to the engine in the case of a flat road is sufficient, this implies that the cooling provided to the engine for an uphill road would be less than what is required; a situation termed as under-cooling. However, if one assumes that the cooling during the uphill condition is sufficient, then the cooling on the flat road is greater than what was required; a situation termed as over-cooling. A similar analysis can be done to compare the performance of the cooling system between a downhill road and a flat road, and would lead to analogous conclusions.

Consider a situation where the vehicle is traveling uphill and the cooling fan is turned on just before reaching the summit. The cooling fan has a significant inertia associated with it, and, in order to avoid constant on-off operation for the fan, a cooling fan is commonly designed such that, once it is turned on, it remains on for some amount of time. If the fan control is based at least in part on future road information, one can potentially avoid turning on the fan just before a summit, since beyond the summit the fan would not be required as the engine temperature itself would fall due to lower power requirements. In addition, when a vehicle is traveling on a downhill grade, the controller can activate the fan and provide an "active-braking" function, while still meeting the engine cooling requirements.

Thus, a cooling system having an operation governed by only the engine RPM is not an optimum solution. A cooling system can be more efficient if controlled under certain conditions based upon upcoming cooling requirements. Efficiencies can also be achieved by embodiments utilizing cooling components (e.g., a coolant pump) that are not driven directly by a gear or other connection to an engine drive shaft.

Modeling Methodology

Although the system in one embodiment desirably operates based upon computing heat transfer characteristics of the system, other approximations can be used. Also, refinements to and alternative forms of modeling and heat transfer computations can be used.

In one exemplary approach, a simulation models the engine, the coolant circuit and the cooling airflow. The engine is the primary source of heat to be removed. In this model, it is assumed that the cold coolant enters the engine block from the bottom and exits through the top or the head of the engine block. While passing through the engine, the coolant picks up heat from the engine block walls and head.

The complete diesel combustion cycle, in this specific exemplary approach, was modeled at crank-angle time intervals to determine the temperature and pressure of the gas mixture. The engine cylinder model was divided into different control volumes (CVs). Mass and energy balance principles were used to compute the work done and the heat transfer from the combustion gases to the engine chamber. The unsteady form of the first law of thermodynamics was applied to each control volume in terms of the control volume temperature, net enthalpy efflux, radiation and convection heat transfer, and stored energy resulting in a set of time dependent differential equations. These differential equations were then solved to obtain the control volume temperatures.

Mass flow rates through the intake and exhaust valves were calculated in this exemplary approach using the equation for compressible flow through a restriction, derived from a one-dimensional isentropic flow exemplary analysis. The single-zone model of combustion was chosen for the analysis. Heat release due to combustion was modeled in this example as consisting of two different modes of fuel burning: a rapid premixed burning phase followed by a slower mixed-controlled burning phase. In the exemplary approach, the fraction of the injected fuel that burns in each of these phases was empirically linked to the ignition delay time.

An exemplary heat transfer model has been developed to calculate the heat transfer from the in-cylinder gases to the engine and from the engine to the coolant. During a combustion cycle, the in-cylinder gas temperature shows a huge variation. In order to accurately estimate the heat transfer from the gases to the combustion chamber walls, it is desirable in one approach to do this heat transfer calculation at the same time step as the combustion cycle time step. Thus, at each crank angle rotation, one exemplary model calculates the mechanical power produced and also the heat transfer from the gases. A cycle-by-cycle calculation is desirably performed in this exemplary approach to determine the heat transfer from the gases to the combustion chamber. The heat transfer is desirably integrated over the entire cycle to calculate the total energy transfer over the combustion cycle, and then time-averaged to determine the rate of energy transfer, (the energy transfer per unit time).

The heat transfer rate from the combustion gases to the combustion chamber depends on the temperature of both the gases and the chamber walls. If an engine is allowed to reach a steady state operation, the walls would reach a constant, time-invariant temperature, and only the temperature of gases would vary during the combustion cycle. Under such conditions, the heat transfer and engine power would have a constant, steady-state value. However, for a vehicle operating in real-life, on-the-road conditions, the equilibrium or steady-state is never reached. This is attributed to the fact that the load on the engine, influenced by required speed and road grade and other variables, continuously changes as the vehicle is traversing a route.

To more accurately calculate the heat transfer under such non-equilibrium, unsteady conditions, one can use transient state heat rejection maps. These maps are used to calculate the transient heat rejection rates as a function of the temperature of the combustion chamber walls temperature. The maps have been developed to compute polynomial coefficients based on fuel rate, boost pressure, and engine RPM, and the coefficients are used to calculate the heat transfer, taking into account the instantaneous wall temperatures.

One exemplary simulation model desirably contains various routines which simulate the engine, radiator, charge air cooler (CAC), fan, airflow circuit, turbocharger, coolant circuit and oil circuit. Most of these major components are modeled mathematically with a transient approach to predict and represent the steady state as well as the transient operation. The exemplary model utilizes three main runtime data, namely: the engine speed, fuel flow rate and the vehicle speed. Selected ambient conditions are also provided as input data.

The engine model is an important component since energy rejection to the coolant and the oil comes primarily from the engine. A six cylinder diesel engine has been modeled in one approach by assuming that all the cylinders are operated at approximately the same operating conditions, making it possible to mathematically model a single cylinder and extend the results to the remaining cylinders. Combustion was modeled, in this example, as a single-zone heat release process. The gas exchange process of this example uses a one-dimensional quasi-steady compressible flow model. The heat transfer model of this example uses empirical correlations for calculating the convective heat transfer. The radiative heat transfer of the model was calculated on the basis of the flame temperature. The frictional model converts selected quantities (e.g., power and indicated specific fuel consumption) to the corresponding brake quantities. A steady-state turbocharger model, manifold heat transfer, and pressure losses were also included in the exemplary simulation. The engine model in this example calculates the surface temperatures and mass-average temperatures for the piston, cylinder head and liner, and the exit temperatures of the coolant and the oil.

An exemplary coolant system comprises the following main components: coolant pump, cab heater, bunk or sleeper heater (if the vehicle is a truck with a separately heated bunk area), engine, oil cooler, thermostat, fan and radiator. Pressurized coolant from the pump is forced through the oil cooler and the engine. Heat rejection from the engine is the main source of energy to the coolant. A full-blocking type thermostat can be used in one example to control the flow of the coolant through the radiator. When the coolant temperature is below a coolant thermostat activation temperature, the closed thermostat directs all the coolant through a bypass conduit to the coolant pump. When the thermostat opening temperature is reached, the coolant thermostat can be controlled so as to open, resulting in coolant flow being divided between the radiator and the bypass conduit.

The coolant pump circulates the coolant through the engine cooling system. The pump can be driven directly off the engine by means of a gear mechanism. However, more desirably the coolant pump is a variable pump that operates at a rate determined by electrical control signals. Data points relating the pump flow with the engine speed can be provided by an engine manufacturer or obtained from engine bench tests. Data points relating the pressure loss through individual components to the flow rate can also be obtained in the same manner. A pump model was developed to calculate the pump flow as a function of the engine speed (for a gear driven pump). Control settings to control an electrically controlled cooling pump to achieve coolant flow rates corresponding to rates at specific engine RPMs for a gear driven coolant pump were determined. The coolant pump within the cooling system was assumed to have no affect on the fluid temperature in this example. The pumping of a fluid through the system generates an increase in thermal energy due to fluid friction, which is dependent on the fluid viscosity and system pressure. For an engine application, in this specific example, these effects can be assumed negligible in comparison to the thermal energy transferred to the coolant from the engine's combustion heat transfer process.

Major assumptions that were made in the exemplary model:

- One-dimensional unsteady compressible flow for calculating mass flow rates past the intake and exhaust valves.
- Intake air and exhaust gases modeled as ideal gases.
- Single-zone combustion model; cylinder charge is assumed to be uniform in both composition and state.
- No losses or leakage from any component in the system.
- One-dimensional heat transfer for the cylinder liner, head and piston.
- Uniform surface area averaged wall surface temperature, constant throughout a combustion cycle.
- Mass averaged, uniform temperatures for the engine bulk materials.

The cylinder volume was modeled as an open thermodynamic system, for intake and exhaust strokes. This was based on the assumption that at any instant in time, the gases inside the open system boundary have a uniform composition, pressure and temperature. Mass and energy conservation equations were then used to derive the differential equations for the rate of change of the open system's thermal properties.

Mass Conservation: The rate of change of total mass of an open system is equal to the sum of the mass flows into and out of the system, expressed as:

$$\dot{m} = \sum_j \dot{m}_j$$

Energy Conservation: The first law of thermodynamics applied to an open system is expressed as:

$$\dot{E} = \dot{Q}_w - \dot{W} + \sum_j \dot{m}_j \cdot h_j$$

Where $Q_w$ and W are the total heat transfer rate into the system across the boundary, and the work transfer rate out of the system. The rate of change of the system energy is expressed as:

$$\frac{d(mu)}{dt} = \frac{d}{dt}(mh) - \frac{d}{dt}(pV)$$

Gas Exchange Model: Valve overlap and reverse flow affects were accounted for in the model. Mass flow rates through the intake and exhaust valves were calculated using the equation for compressible flow through a restriction, derived from a one-dimensional isentropic flow analysis. Instantaneous values of valve lift on a crank angle basis were provided by DDC. Knowing the valve diameter, instantaneous values of area, the mass flow rate was calculated at each step of the gas exchange process.

Combustion Model: Diesel combustion is a complex, heterogeneous process and a comprehensive combustion analysis would require accurate models of compressible viscous air motion, fuel spray penetration, droplet break-up and evaporation, air entrainment into the spray, combustion kinetics, turbulent diffusion etc. The zero-dimensional or single zone model of combustion, used for the present model, does not take into account atomization, liquid jet and droplet motion, fuel vaporization, air entrainment and ignition chemistry. The fuel injected into the cylinder is assumed to mix instantaneously with the cylinder charge which is assumed to behave as an ideal gas.

Heat Release Rate:

$$\dot{m}_t = \dot{m}_p + \dot{m}_d$$

where, $\dot{m}_p$=premixed burning rate $\dot{m}_d$=diffusion-controlled burning rate $\dot{m}_t$=apparent fuel burning rate with respect to crank angle Ignition Delay Time:

$$t_D = Ap^{-n}\exp\left(\frac{E_A}{RT}\right)$$

Heat Transfer Model: The different heat transfer mechanisms dealt with in the exemplary model include forced convection from the turbulent flow in the cylinder to the combustion chamber walls, forced convection from the cylinder walls and head to the coolant and from the piston to the cooling oil, radiation from the flame and the burning carbonaceous particles and conduction through the combustion chamber walls.

Convective Heat Transfer: Nusselt number relations.

$$Nu = aRe^m Pr^n$$

Radiative Heat Transfer:

$$Q_r = C\sigma(T_g^4 - T_w^4)$$

Engine Cylinder Model: The engine cylinder model of this example was divided into eight different control volumes: cylinder liner, head surface, piston, bulk cylinder wall, cylinder head bulk, block coolant, head coolant, and piston cooling oil. The unsteady form of the first law of thermodynamics was applied to each control volume in terms of mass-averaged control volume temperature, net enthalpy efflux, radiation and convection heat transfer, and stored energy resulting in a set of eight time dependent differential equations. These differential equations were then solved to obtain the temperatures of the engine and the coolant.

Transient-state Heat Rejection Maps: The exemplary model captures the physics of two distinct processes: combustion and heat transfer. The combustion calculations have a 'high' time dependency; the calculation is desirably performed at each crank angle rotation to keep track of the physical properties of the mixture in the cylinder. On the other hand, the heat transfer model has a greater thermal inertia and desirably can be less frequently performed, such as no more than once every second, to keep track of the bulk temperatures. For a real-time implementation of the model and developing a real-time controller, it can be desirable to speed up the calculations. A crank angle scale combustion computation is undesirably slow. Therefore, a more desirable model is based upon transient-state heat rejection maps.

The transient maps in one exemplary approach take the bulk temperatures, engine RPM, and fuel rate input at the start of every combustion cycle and compute the following cycle variables: power or useful work delivered, bulk metal temperatures and coolant temperatures at the end of the combustion cycle. By solving the complete set of equations only once every cycle in this example, the model does away with performing the calculation multiple times (e.g., 720 times) during the combustion cycle.

The heat release rate calculation, through the maps, is dependent on linear coefficients that vary with the engine RPM and fuel rate, and on the material temperatures. Since, the three independent variables of engine RPM, fuel rate, and engine temperatures can be approximated to hold constant over a cycle, a single computation per cycle can be used and can be sufficient to capture the thermal responses of the system.

Cooling System Model: The engine is the main source of energy to the cooling system, and the rest of the components of the cooling system ensure that the engine's energy is released into the ambient surroundings. In an exemplary system, a coolant pump maintains a closed circuit coolant flow, a fan provides the cooling air flow, and the radiator is the primary heat exchanger that facilitates transfer of thermal energy from the coolant to the cooling air. These components taken together are the major constituents of such a cooling system. Other components can also be included, such as explained below.

In the truck designs, a charge air cooler and AC condenser are typically installed in front of the radiator, in the pathway of the air flow through the vehicle grille. This means that the cooling air flow exchanges heat with the condenser, and with the charge air cooler, and lastly with the radiator. Thus, to model the radiator heat transfer in such a system, it becomes desirable to account for the presence of the two other heat exchangers present in the air flow path. The coolant in the radiator exchanges heat with the cooling air; this cooling air is, however, not at the ambient temperature but its temperature has been augmented by the heat exchange taking place in the other two heat exchangers. Additionally, the flow rate of cooling air in the presence of these heat exchangers is less than what it would have been had these heat exchangers been absent from the flow path. This is accurately understood and can be modeled using pressure drop versus flow rate curves for the system and its constituent parts. For such reasons, the simulation desirably includes thermal models for the charge air cooler and condenser as well.

Exemplary Vehicle Thermal Cooling System

FIG. 3 illustrates an exemplary thermal cooling system for a land vehicle and also illustrates a data communications bus 14 coupled to various sensors to receive input signals and to provide control signals to components of the thermal system. In addition, a PALM controller 16 is coupled to the databus and thus can communicate via the databus with the various components of the thermal system. Although less desirable, the PALM controller could alternatively be hardwired directly to one or more of the thermal components and sensors.

In FIG. 3, an engine block 100 is illustrated. The primary source of heat in the system arises from combustion within the engine block. Coolant from engine block 100 is delivered via a conduit 102 through an optional brake retarder 104 and a conduit 106 to a coolant thermostat 108 which can be controlled between open and closed positions in response to control signals $S_{ct}$ via bus 14 to a coolant thermostat controller 110. The coolant thermostat 108 can be a two position thermostat (open or closed) or a variable thermostat in the sense that it can be controlled to open varying amounts in response to the control signals. In the event coolant thermostat 108 is closed, a pathway exists via a bypass conduit 116 to a coolant pump 120. When coolant thermostat 108 is open, a pathway 122 is provided to a vehicle radiator 130 with coolant passing through the radiator 130 to a conduit 132 and to the cooling pump 120. A portion of the coolant can also be simultaneously delivered via conduit 116 to the coolant pump 120. Depending upon the position of coolant thermostat 108, in the case of a variable position coolant thermostat, all or selected portions of coolant can be delivered via the pathway 122 and through the radiator. The coolant pump 120 can be driven (e.g., via a gear) by the engine for operating when the engine is running. However, more desirably, coolant pump 120 is an electrically controlled coolant pump capable of pumping a varied volume of coolant through the pump depending upon coolant pump control signals. In the embodiment of FIG. 3, coolant pump control signals $S_{cp}$ are delivered to a coolant pump controller 134 for controlling the coolant pump 120 to operate at the desired rate. Typically coolant pump 120 operates at some minimal rate so that some minimal liquid coolant is recirculated in the coolant system at all times when the engine is operating. Liquid coolant passing through the coolant pump 120 is delivered via a conduit 140 and through an optional exhaust gas recirculation (EGR) cooler 142 and to a conduit 146. From conduit 146, the liquid coolant passes through an oil cooler (heat exchanger) 150 to cool engine oil. An exemplary oil cooling circuit is explained below. The coolant passing through the oil cooler 150 is delivered via a conduit 152 back to the engine block 100.

In the system of FIG. 3, a cooling fan 160 is also illustrated. Desirably the cooling fan is electrically operated by an electric motor 162 in response to control signals from a fan controller 164. These fan control signals $S_F$ are desirably provided to fan motor control 164 from the databus 14. Although a variable speed fan can be used, in one implementation the fan is either turned on or off in response to the control signals $S_F$. Typically when turned on, the fan remains on for a period of time. The fan can be responsive to coolant temperature set points. When on, the fan assists in moving air across the radiator 130 to cool the liquid coolant passing through the radiator. The exemplary system in FIG. 3 comprises a turbocharger and optional emission gas recirculation (EGR) valve 170. The turbocharger provides charge air via line 172 and through a charge air cooler 174 and a conduit 176 (B) to a charge air inlet 178 (B) to the engine block 100. At least some of the charge air in this example is provided to the turbocharger 170 by way of an inlet 180 (A) coupled to an outlet 182 from the EGR cooler 142 such that recirculating emission gases are included in the charge air in this example.

An air conditioning condenser 180 is also shown adjacent to the charge air cooler and in the air flow path for receiving air (indicated by arrows 200) that has passed through a grille 202. An optional closure mechanism such as a shutter 210 is shown positioned adjacent to the grille for selectively closing the openings through the grille and thus the passageway for ambient air, indicated by arrows 212, impacting the truck grille from entering the engine compartment through the grille. The shutter 210 can also selectively close other openings, such as bumper openings at the front of the truck. Control signals $S_s$ are delivered via bus 14 and to shutter controller 214 (which can control a shutter motor, not shown) for use in controlling the shutter between open and closed positions, and/or between selected positions therebetween. An exemplary shutter system is disclosed in published U.S. Patent Application 2006/0102399, Ser. No. 11/211,331, entitled Selective Closing of at Least One Vehicle Opening at a Front Portion of a Vehicle, to Guilfoyle et al. application Ser. No. 11/211,331 is hereby incorporated by reference herein.

The engine block 100 is schematically illustrated as including an oil sump 220 at a lower portion of the engine block. An outlet conduit from oil sump 220 is coupled to an oil pump 222 and via an oil thermostat 224 to the oil cooler 150 when the oil thermostat 224 is open. Cool oil from oil cooler 150 is returned, via a conduit 250 to the oil sump 220. In the event oil thermostat 224 is closed, oil is delivered via a bypass conduit 252 to the conduit 250 and back to the oil sump. The oil thermostat 224, in this example, can be electrically controlled by way of oil thermostat control signals $S_{OT}$ from bus 14 delivered to a controller 254 coupled to the oil thermostat 224. Also, the operation of the oil pump 222 can be controlled by oil pump control signals $S_{OP}$ delivered from databus 14 to an oil pump controller 256. Alternatively, set points can be used to control the oil thermostat and a gear driver oil pump can be used.

In the illustrated system of FIG. 3, a simplified diagram for an interior compartment heating system is also disclosed, such as a cab heater 260 and bunk heater 261 within the interior of a truck cab. When a cab heater control valve 262 is open, heat containing coolant passes from conduit 146, through oil cooler 150, and a conduit 264 through the cab heater valve 262 to a heat exchanger comprising a portion of the cab heater. When a bunk heater control valve 263 is open, heat containing coolant passes from conduit 146, through oil cooler 150, and a conduit 265 through the bunk heater valve 263 to a heat exchanger comprising a portion of the bunk heater. One or more fans or other heat transfer mechanisms may be used to transfer heat from the cab heater and bunk heater (if included) to the interior of the cab via heating ductwork or passageways. The operation of heater valve 262 can be electrically controlled via heater control signals $S_{H1}$ delivered from databus 14 to a heater valve controller 270. The operation of heater valve 263 can be similarly electrically controlled via heater control signals $S_{H2}$ delivered from data bus 14 to heater valve controller 271.

In the embodiment of FIG. 3, many of the thermal system components are described as being electrically controlled. This is a particularly desirable approach. However, advantages can also be achieved in the event temperature controlled thermostats are used with or without an electrically controlled coolant pump. That is, in a predictive approach where terrain along a portion of the route is known and where the vehicle is being operated under predictive operating conditions, a system can operate in the conventional manner except for delaying the operation of the cooling fan at selected times (for example, as a crest of a hill is approaching). More desirably, at least the coolant pump, coolant thermostat and cooling fan are electrically controlled to facilitate the passage of variable amounts of liquid coolant through the primary coolant passageways to enhance cooling of the system either in response to instantaneous vehicle operating conditions or in response to predictive control based on upcoming elevation changes in the terrain. For example, additional amounts of coolant can be circulated by the cooling pump as a vehicle travels downhill to in effect increase the cooling of the liquid coolant in preparation for the vehicle climbing an upcoming hill. Also, the shutter system can be controlled to enhance cooling at desired times based on predictive or advance knowledge of upcoming terrain changes. It should be noted that closing of the shutter 210 enhances the aerodynamic efficiency of the vehicle and thereby decreases fuel usage in many instances.

In addition to the control signals previously noted, ambient conditions and vehicle operating conditions can be sensed and converted to signals which are also delivered to the bus 14. Some of these signals comprise the following: $R_{AV}$=RAM air velocity; FR=fuel rate; RPM=engine rpm; $T_A$=temperature/ambient; $P_A$=pressure/ambient; $T_{CA}$=temperature charge air (at turbocharger 170 outlet); and $T_{CEO}$=temperature of coolant at the engine output (e.g., at entrance to conduit 102).

These signals can be used in a desirable embodiment to calculate the amount of heat transfer for removal by the cooling system to achieve a desired temperature profile for the engine operating under predictive operating conditions as it travels along future portions of a route. Various control signals can be generated to cause the engine to operate so as to have a temperature that follows the optimum temperature profile to thereby achieve benefits, such as to optimize a cost function.

Figure 4:
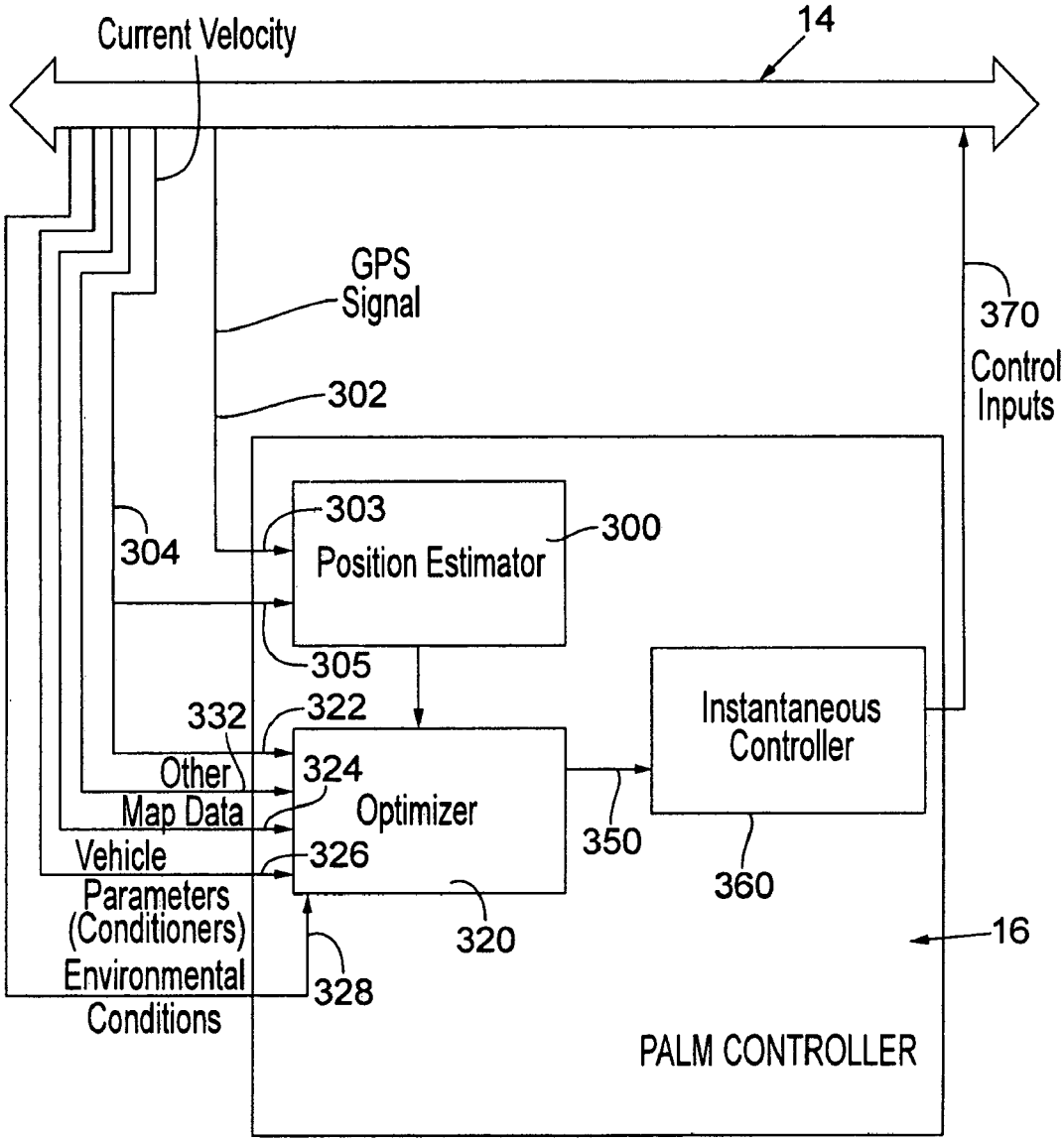
FIG. 4 is a more detailed block diagram of one exemplary form of a PALM controller.

FIG. 4 illustrates a block diagram of one form of a PALM controller 16 in accordance with the disclosure. The illustrated PALM controller 16 comprises a position estimator 300 operable to compute the position of the vehicle at a given instant in time. Desirably, the vehicle is equipped with a position sensor such as a GPS receiver for receiving a GPS signal indicative of the position of the vehicle, such as by longitude and latitude. The GPS signal, or a representation thereof, is delivered via a line 302 to one input 303 of the position estimator. In addition, the current vehicle velocity, or data from which the velocity can be calculated, is delivered via a line 304 to another input 305 of the position estimator. From this data the position estimator can compute the current position of the vehicle and estimate when the vehicle will reach future positions. The controller 16 also comprises an optimizer 320, that can comprise a programmable controller having a processor and associated memory. The controller can be pre-programmed or can be provided with an input, such as for receiving original and/or updated programming instructions via the databus 14.

One or more inputs can be provided to the optimizer 320. For example, the current velocity can be provided at an input 322 and map data can be provided at an input 324. Typically, the map data provides elevation information for upcoming portions of the route and can be searched in segments based upon the estimated position of the vehicle. Vehicle parameter information can be provided at an input 326 to the optimizer 320. For example, vehicle conditions, such as indicated in FIG. 3 (e.g., condition of coolant pump, condition of fan, condition of shutters, charge air temperature, and so forth). Environmental conditions can also be provided via an input 328, such as the ambient temperature and ambient pressure information. The data provided to the optimizer 320 is not limited to these specific data inputs as represented by an input 332 labeled as "Other" in FIG. 4. For example, traffic information (e.g., an upcoming traffic slowdown, road repair slowdown) can be provided. As another example, a driver profile can be provided for the vehicle driver, if available, that can be used in predicting how a truck will be operated by the profiled driver over a road section in the event cruise control is off.

The optimizer 320 can operate in a number of different modes. For example, assuming both the map data and position indicating information is available, and the vehicle is being operated under predictive conditions, the optimizer 320 can operate as a predictive controller. For example, from the available information, the optimizer 320 can compute a desired engine temperature profile and deliver this profile via an output 350 to an instantaneous controller 360. For example, the desired temperature profile can be based on the temperature that the engine is allowed to reach at various points along the route in a manner that minimizes a cost function (for example limiting the turning on of the vehicle fan). A temperature profile can be computed based on estimating the heat transfer required for the vehicle to operate at the desired engine profile corresponding to locations along the route. The instantaneous controller 360 then determines and provides control inputs to the databus 14 for controlling various components of the vehicle so that the vehicle is operated in a manner that causes the engine temperature to follow the determined temperature profile. These control inputs can, for example, include control signals for the electric coolant pump; electric coolant thermostat; electric oil thermostat; electric fan; electric shutters; and electric cab heater valve in the event electrically controlled components are used for these elements of the vehicle thermal system. These control inputs are provided via a line 370 to the databus. In the event the map data and/or the GPS signal or position information is unavailable or the vehicle is not being operated under predictive conditions, the system can nevertheless operate the cooling system based upon instantaneous conditions. For example, the thermostat can be opened if the coolant temperature is increasing (e.g., based on the rate of increasing temperature) before a set point is reached. As another example, during cold engine startup, a minimum coolant flow rate can be established and maintained with the coolant thermostat closed to increase the initial heating of coolant by the engine.

Although the position estimator, optimizer and instantaneous controller are depicted in FIG. 4 as discrete blocks, this is not to be construed as a limitation. That is, the functionality of these components can be combined or distributed.

Figure 5:
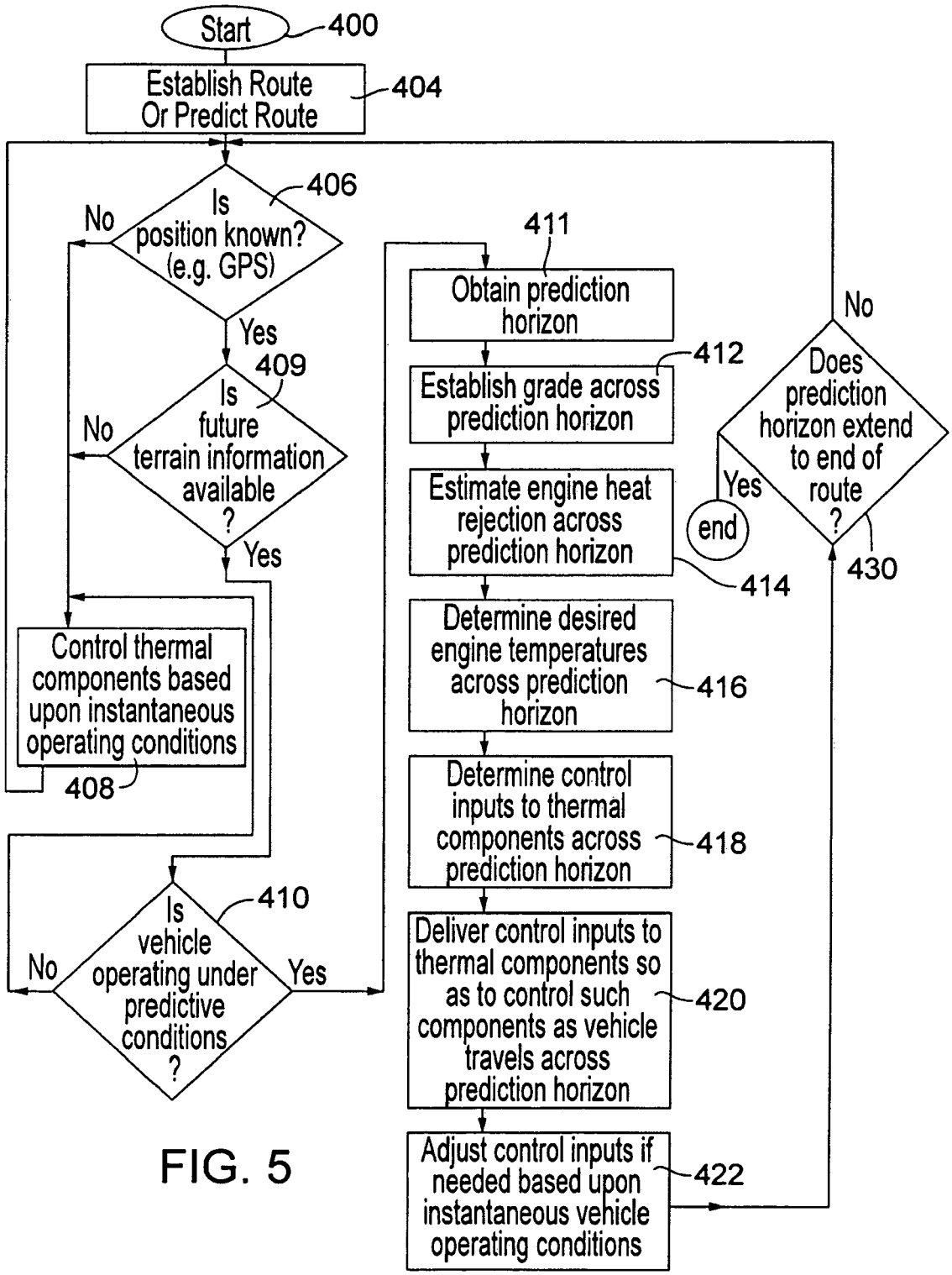
FIG. 5 is an exemplary flow chart for operation of the PALM controller of FIG. 4.

One exemplary control approach for optimizer 320 is illustrated in connection with FIG. 5. The approach starts at block 400 in FIG. 5. From block 400 a block 404 is reached at which the route is established (e.g., by user input) or a segment of a route is predicted. For example, the exact route may not have been established, such as by a driver. In such a case, a predictive route approach can be used with a next segment of a route being predicted from a known position and direction of travel. At block 406 a determination is made as to whether the vehicle position is known (e.g., whether a GPS signal is available). If the answer is no, a block 408 is reached and control of thermal components to the vehicle are based upon instantaneous operating conditions, desirably based both on vehicle parameters and environmental conditions.

Assuming at block 406 it is determined that the vehicle position is known, a yes branch from block 406 is followed to a block 409 where a determination is made as to whether the terrain information is available. If the answer is no, the block 408 is again reached. On the other hand, if at block 408 the answer is yes, a block 410 is reached where a determination is made of whether the vehicle is being operated under predictive conditions. One specific example is to determine whether the vehicle is being operated under cruise control, which enhances the predictability of how the engine will operate. It is expected that sufficient predictability can also be determined to exist where a predictive model or driver profile for the vehicle driver is available. From block 410, a block 411 is reached. At block 411 a prediction horizon (e.g., an upcoming route segment) is obtained and at block 412 the grade information is established across the prediction horizon (based for example upon elevation changes in the map applicable to the prediction horizon). If the route is known or no exits exist for successive prediction horizons, successive prediction horizons can be obtained and processed at a given time. At block 414, the engine heat rejection across the prediction horizon is estimated and block 416 a desired engine temperature profile across the prediction horizon is determined. At block 418 control inputs are determined for thermal components across the prediction horizon to cause the vehicle to operate such that the engine temperature matches the desired engine temperature profile. By match, it is meant that the actual engine temperature closely approximates the actual optimum temperature across the prediction horizon.

The control inputs are then delivered to the thermal components at appropriate times as the vehicle traverses the prediction horizon so as to control the components to achieve a match of the actual engine temperature to the optimized engine temperature. Feedback is provided such that the control inputs can be adjusted, at block 422, in the event instantaneous vehicle operating conditions indicate such adjustments are needed (e.g., the liquid coolant is approaching its maximum allowed temperature). From block 422, a block 430 is reached where a determination is made as to whether the prediction horizon extends to the end of the route. If the answer is yes, the vehicle has reached its destination. If the answer is no, the block 406 is again reached and the process continues for the next prediction horizon. It should be noted that, if the route is known or there are no road exits from the road over a plurality of successive prediction windows, plural prediction horizons for a route can be processed at one time to provide control inputs for system components for plural predictive windows as the vehicle travels along the route. Alternatively, the prediction horizons may be processed in series with the next prediction horizon being processed following the processing of the preceding prediction horizon and while control inputs for the preceding prediction horizon are being delivered to the thermal components.

As another more detailed example, the following should be considered.

Consider a thermal cooling system with the following electrical components:

Electric Coolant Pump

Electric Coolant Thermostat

System Modeling:

Force balance at vehicle center of mass: (Longitudinal Dynamics):

$$Ma=F_{fueling}-F_{engine\ friction}-F_{engine/service\ brake}-F_{Inertial}-F_{Drag}-F_{Roll}-F_{Grade}-F_{Aux}$$

Internal Forces:

$$F_{fueling}=\eta kT_e$$

$$F_{Aux}=\eta kT_{Aux}$$

$$F_{engine\ friction}=f(\omega)$$

$$F_{engine\ brake}=\eta kT_{engine\ brake}+F_{service\ brake}$$

$$F_{Intertial}=\eta J_{eng}k^2a+\frac{J_{wheels}}{r_{wheels}^2}a$$

$$k=\frac{\text{engine speed}}{\text{vehicle speed}}\approx\frac{n_{drive}n_{transmission}}{r_{wheels}}$$

External Forces:

$$F_{Drag}=\frac{c_{air}A_L\rho(v+V_{wind})^2}{2}=C_{Drag}(v+V_{wind})^2$$

$$F_{Grade}=Mg\sin\theta$$

$$F_{Roll}=MgC_{rr}\cos\theta$$

Full Dynamics:

$$M_{eff}\dot{v}=\eta kT_e-C_{drag}(v+V_{wind})^2-Mg\sin\theta-MgC_{rr}\cos\theta-F_{\substack{engine\\friction}}-F_{\substack{engine/\\service\\brake}}-\eta kT_{Aux}$$

$$M_{eff}=M+\left(\eta J_{eng}k^2+\frac{J_{wheels}}{r_{wheels}^2}\right)$$

System Equation:

$$m\frac{dv}{dt}=f(\theta(x),v,T_{end},T_{Aux})$$

where $\theta(x)$=Road Grade $v$=Vehicle Velocity $T_e$=Engine Torque $T_{Aux}$=Auxiliary Torque The above system equation shows that the vehicle acceleration is a direct function of the grade, current velocity, engine torque, and auxiliary torque. The engine wall temperature and engine coolant temperature at any instant can be expressed as a function of the current engine speed, engine torque, vehicle velocity, and ambient temperature.

$$\dot{T}_w=f_1(N_e,T_e,v,T_{amb})$$

$$T_{c,out}^{\bullet}=f_2(T_{c,in},T_w,\dot{m}_c)$$

where $N_e$ is the engine speed $T_{amb}$ is the ambient temperature $T_{c,in}$ is the engine inlet coolant temperature $T_w$ is the engine wall temperature $\dot{m}_c$ is the coolant flow rate Cost Function:

Minimize the energy consumed by the coolant pump. ($J_{pump}$)

The energy consumed by the coolant pump will be minimal if the coolant flow rate is minimized.

$$\dot{m}_c=f(u_{pump})$$

$$J_{pump}=\lambda_1\int_{t_0}^{t}(\dot{m}_c)dt$$

Minimize fan activation by controlling the coolant temperature below the fan activation temperature and the maximum allowable limit to prevent engine speed and torque derates. Also maintain the engine wall temperature within the maximum allowable limit. ($J_{bound}$)

$$J_{bound}=\lambda_2\int_{t_0}^{t}(T_{c,out}-T_{c,fan})^2\sigma(T_{c,out}T_{c,fan})dt+\lambda_3\int_{t_0}^{t}(T_{c,out}-T_{c,\max})^2\sigma(T_{c,out}T_{c,\max})dt+\lambda_4\int_{t_0}^{t}(T_w-T_{w,\max})^2\sigma(T_wT_{w,\max})dt$$

$$\sigma(\xi)=\begin{Bmatrix}1 & \xi\geq 0\\ 0 & \xi<0\end{Bmatrix}$$

Minimize engine wall temperature variation from reference. ($J_{wall}$)

$$J_{wall}=\lambda_5\int_{t_0}^{t}(T_{w,des}-T_w)^2dt$$

Minimize coolant temperature variation from reference. ($J_{coolant}$)

$$J_{coolant}=\lambda_6\int_{t_0}^{t}(T_{c,out,des}-t_{c,out})^2dt$$

Lumped Cost Function to be minimized:

$$J=J_{pump}+J_{bound}+J_{wall}+J_{coolant}$$

The objective in this example is to find the thermostat and coolant pump commands to minimize the Lumped Cost Function across the prediction horizon, and then the values of the Desired Engine Wall and Coolant temperatures that correspond to these optimal control commands.

Thus, in accordance with the above example, control of the components is instituted in order to minimize a cost function that, in the illustrated example, is comprised of a plurality of lumped cost functions. These specific cost functions of this example are: $J_{pump}$; $J_{bound}$, $J_{wall}$; and $J_{coolant}$. Different cost functions can also be utilized. In addition, one or more of these described cost functions can be utilized even though a more desirable approach is to utilize at least these four cost functions in the analysis.

Additional examples are illustrated in connection with FIGS. 6-9. In the examples of FIGS. 6-9, hypothetical examples, an instantaneous control approach has been illustrated without using the predictive control based on knowledge of upcoming terrain changes.

Notations used in FIGS. 6-9 examples:

$T_{max/min}$=max/min coolant temperature allowed in the cooling system, e.g., ΔT~10° C.

$T_{FAN\ max/min}$=max/min coolant temperature for turning on/off engine fan $T_{CP\ max/min}$=max/min coolant temperature for speed increase/decrease @ electrical cooling pump $T_{TH\ max/min}$=max/min coolant temperature for opening/closing the electrical thermostat valve $T_{SH\ max/min}$=max/min coolant temperature for opening/closing the grille shutter Further explanation of examples of FIGS. 6-9:

For the high coolant thermostat temperature (see the cross-hatched rectangular area), there is desirably an equivalent range of values instead of a constant threshold value (e.g., $T_{max}$=85° C. for 10% opening; $T_{max}$=86° C. for 50%; $T_{max}$=87° C. for 100% opening)

Similar ranges of values are desirably used for high temperature values for an electric cooling pump; not represented here for convenience.

Figure 6:
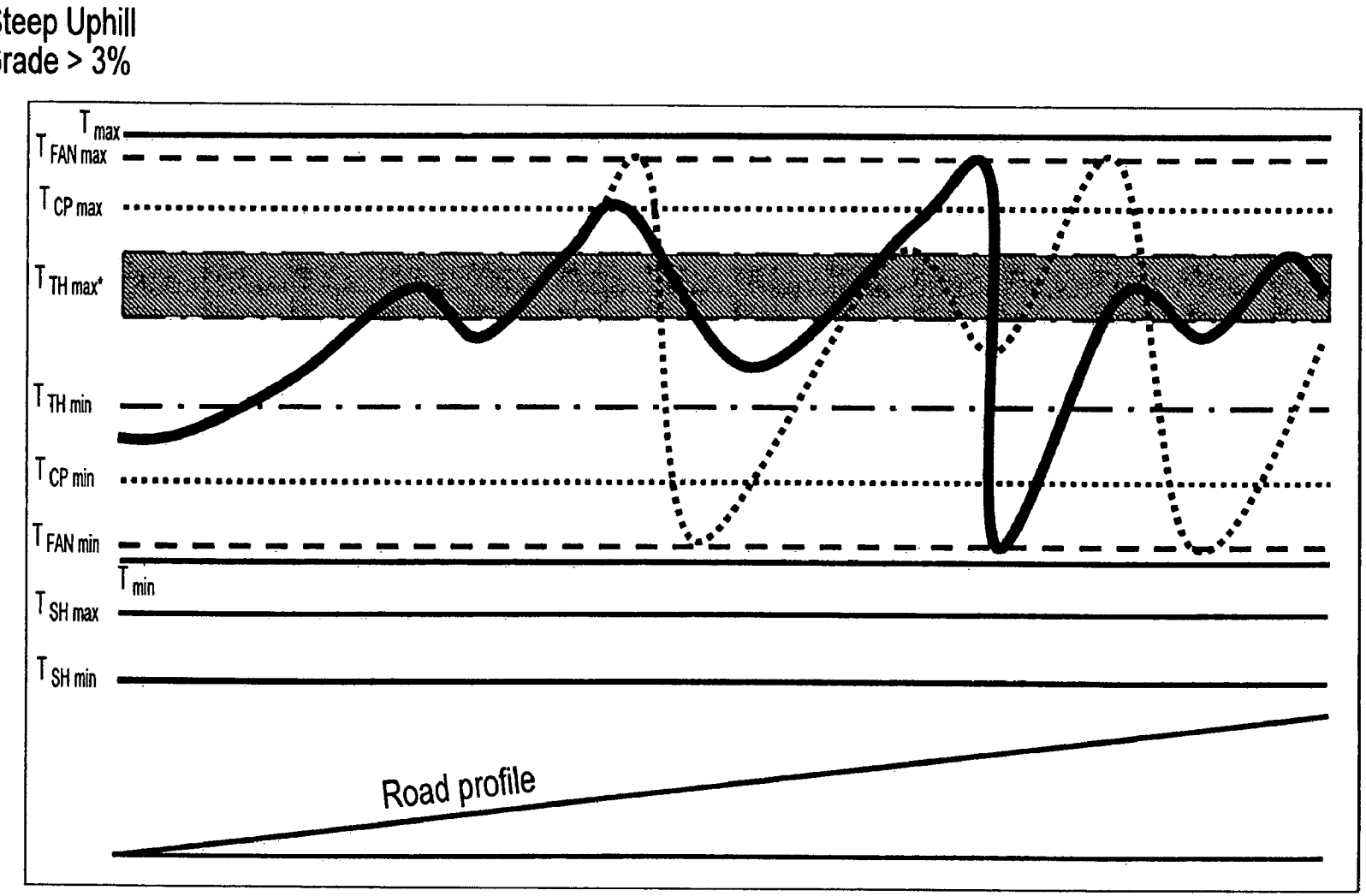
FIGS. 6-8 illustrate the exemplary operation of various exemplary thermal components of one form of a thermal cooling system of a land vehicle in response to commands from a PALM controller for various exemplary road section profiles when such components are operated in response to instantaneous vehicle conditions. These figures also compare such operation with an exemplary operation of a system without a PALM controller
Figure 7:
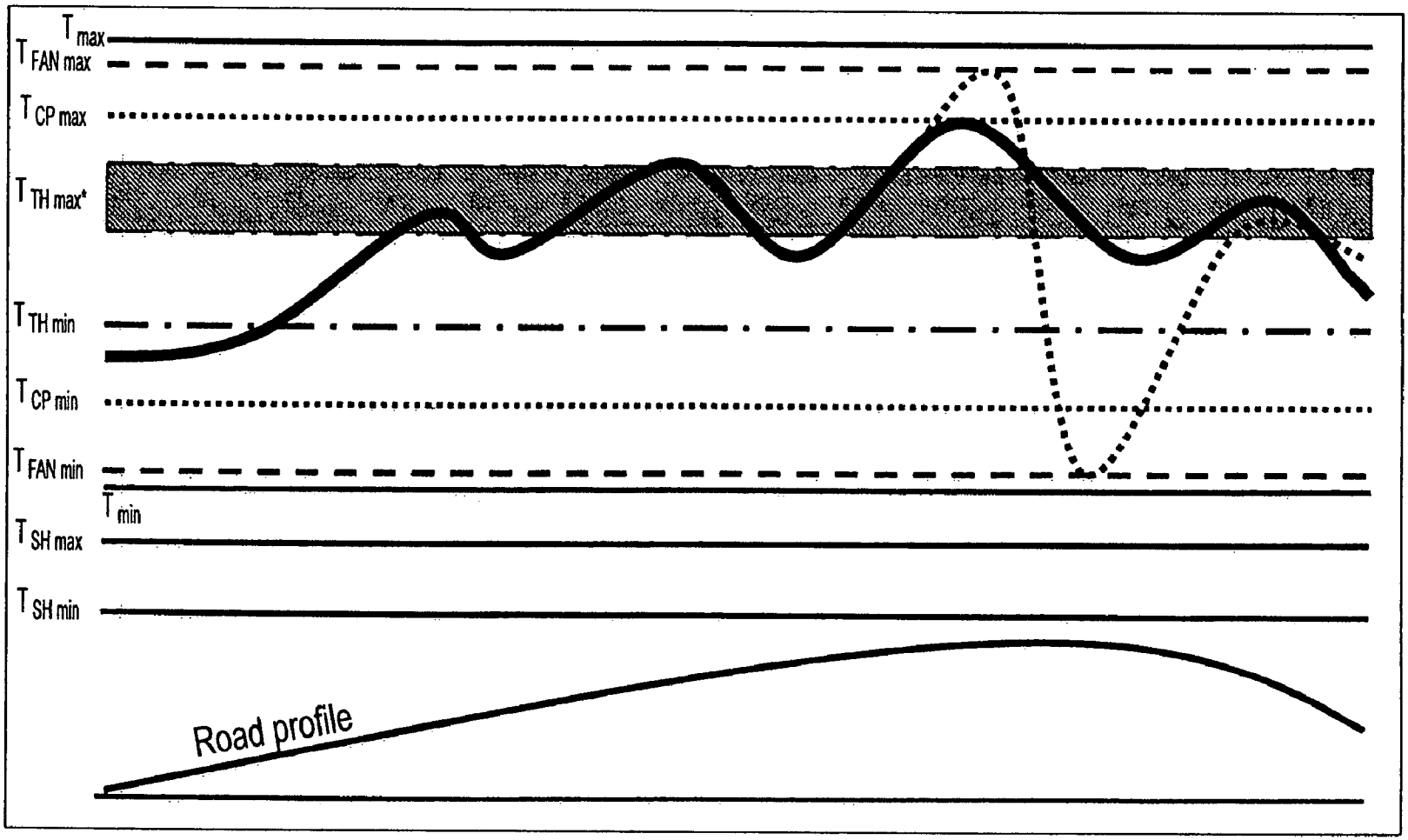
Figure 8:
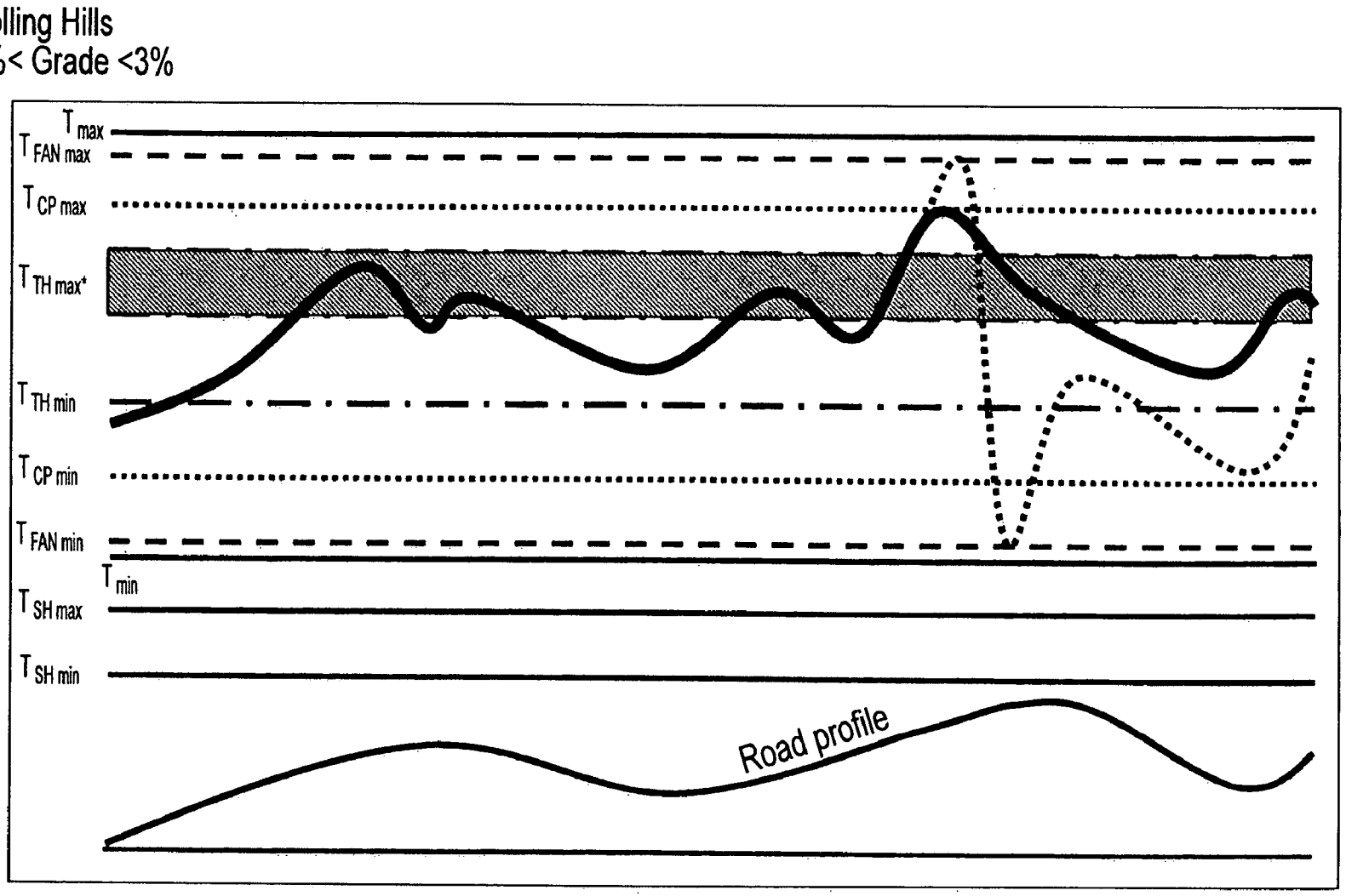

The heavy black line trajectory in FIGS. 6-8 represents the coolant temperature variation in a system (New System Example) with an electrically controlled coolant pump, electrically controlled fan and electrically controlled coolant thermostat.

The black dotted trajectory in FIGS. 6-8 represent the coolant temperature variation in a system using a gear driven coolant pump and fan controlled by upper and lower coolant temperature set points (Legacy System)

The examples of FIGS. 6-8 are of an instantaneous control approach; no predictive control is included in these figures (e.g., terrain and/or position information is lacking or not used).

FIG. 6; an example of a Steep Uphill Scenario 1 (grade>3%)

FIG. 6 shows two fan events (fan switched on twice) in the Legacy System vs. one fan event in the New System Example).

In FIG. 6, the Legacy System behavior at the beginning of the climb is identical to the behavior of the New System Example.

FIG. 7; An example of a Steep Uphill Scenario 2 followed by a downgrade.

FIG. 8; Rolling Hills Scenario 3 (grade varies between 0 and 3%/+/−).

Fan events (turning on the fan) can easily be eliminated in the FIGS. 7 and 8 examples of the New System Example operation by varying the operation of the coolant thermostat and by changing (e.g., continuously varying) the rate at which the engine coolant pump is pumping coolant through the radiator of the New System Example.

The predictive operating mode (e.g., using knowledge about incoming grade facilitates improved control of electrically controlled auxiliaries to keep the coolant temperature in a desired higher temperature range (high-end values; e.g., no more than 10° C. variation).

One exemplary front grille shutter system, if used, has a very simple logic: if ambient temperatures are under $T_{min}$, then desirably the shutter system is operated such that the front grille is closed (e.g., completely closed). If the ambient temperature is too high (e.g., at or above a threshold), desirably the shutter system is operated to open the front grille (e.g., completely opened). Desirably, although this can be varied, the shutter system is not operated to open when driving, unless ambient temperatures vary significantly or opening is required to enhance engine cooling. Also, when there is a fan event (the fan is switched on), the shutter is desirably operated to be fully open, otherwise switching the fan on is inefficient.

Having illustrated and described the principles of our invention with respect to several embodiments, it should be apparent to those of ordinary skill in the art that the embodiments may be modified in arrangement and detail without departing from the inventive principles disclosed herein. Thus, for example, the disclosure encompasses a system operable based upon either or both (a) instantaneous conditions without predictive information; and (b) predictive information. We claim as our invention all such modifications as fall within the scope of the following claims.

We claim:

1. A method of operating a vehicle having a vehicle fan for assisting in the cooling of liquid coolant circulating in a vehicle engine cooling system, the method comprising:

under first vehicle operating conditions, turning on the vehicle fan when the coolant temperature reaches a first coolant temperature below a maximum coolant temperature; and under second vehicle operating conditions wherein the vehicle is approaching the crest of a hill, preventing the operation of the vehicle fan even though the coolant temperature has reached or exceeded the first coolant temperature and is below the maximum coolant temperature.

2. A method according to claim 1 comprising removing additional heat from the coolant in anticipation of the beginning of the hill.

3. A method of operating a vehicle fan and a coolant pump for assisting in the cooling of coolant liquid being circulated by the coolant pump in a vehicle engine cooling system, the method comprising:

under first vehicle operating conditions, operating the coolant pump to pump coolant at least at a first rate greater than a minimum coolant pumping rate when the coolant temperature reaches a first temperature below a maximum coolant temperature;

under second vehicle operating conditions wherein the vehicle is going down a grade, operating the coolant pump to pump coolant at least at the first rate even though the coolant temperature is below the first temperature to provide additional cooling of the coolant fluid prior to climbing a grade.

4. A method according to claim 3 comprising;

under third vehicle operating conditions, turning on the fan and operating the coolant pump at least at the first rate when the coolant temperature reaches a second temperature above the first temperature and below the maximum coolant temperature; and under fourth vehicle operating conditions wherein the vehicle is going down a grade, turning on the fan and operating the coolant pump at least at the first rate even though the coolant temperature is below the second temperature.

5. A method of operating a vehicle engine cooling system of a vehicle traveling along a route, the cooling system having cooling fluid circulating in the cooling system, the method comprising:

determining the presence of an upcoming uphill grade in a section of a route that has yet to be traversed by the vehicle; and operating the cooling system to remove a first quantity of heat from the cooling fluid prior to reaching the upcoming uphill grade, the first quantity of heat being greater than the quantity of heat that is removed by the cooling system in the absence of the upcoming uphill grade.

6. A method of operating a vehicle engine cooling system of a vehicle traveling along a route, the cooling system having cooling fluid circulating in the cooling system, the method comprising:

determining a desired vehicle engine temperature profile correlated to positions along a section of the route; and controlling the operation of the cooling system to cause the temperature of the vehicle engine to match the desired vehicle engine temperature profile when the vehicle travels along the section of the route.

7. A method according to claim 6 wherein the act of determining comprises determining a desired vehicle engine temperature profile based at least in part upon existing vehicle operating conditions and the elevation at various locations along the section of the vehicle route.

8. A method according to claim 6 wherein the engine temperature profile is at a substantially constant temperature for a given section of the route for which (a) the elevation is unchanged throughout the given section of the route; and (b) the elevation is unchanged in both the section of the route immediately prior to the given section and immediately following the given section.

9. A method according to claim 8 wherein the substantially constant temperature is within about ten degrees C.° of the maximum allowable engine operating temperature.

10. A method according to claim 6 wherein the act of determining comprises determining a desired engine temperature profile based at least in part as a function of engine speed and engine torque.

11. A method according to claim 6 wherein the act of determining comprises determining a desired engine temperature profile based at least in part upon an estimation of the addition of heat to and the removal of heat from cooling fluid in the cooling system arising from heating the cooling fluid due to the operation of the engine over the route section and arising from cooling of the cooling fluid by at least one cooling component of the cooling system.

12. A method according to claim 11 wherein the at least one cooling component comprises at least a cooling pump and a radiator fan.

13. A method according to claim 12 wherein the at least one cooling component also comprises a radiator closure mechanism operable to selectively block the delivery of air to a radiator of the cooling system.

14. A method according to claim 6 wherein the act of determining comprises determining a desired engine temperature profile that minimizes at least one cost function.

15. A method of operating a vehicle engine cooling system of a vehicle traveling along a route, the cooling system having cooling fluid circulating in the cooling system, the method comprising:

receiving information indicating the presence of upcoming traffic or road work conditions in a section of a route to be traveled by the vehicle that would result in a need to slow down the vehicle when such traffic conditions or road work conditions are encountered by the vehicle; and operating the cooling system to remove a first quantity of heat from the cooling fluid prior to reaching the location of the traffic or road work, the first quantity of heat being greater than the quantity of heat that is removed by the cooling system in the absence of receiving information indicating the presence of upcoming traffic or road work conditions.

16. A vehicle comprising:

an engine;

a vehicle engine cooling system for receiving and circulating liquid coolant to cool the engine;

a vehicle fan operable to assist the cooling of liquid coolant circulating in the vehicle engine cooling system;

the vehicle engine cooling system comprising a coolant pump operable to circulate liquid coolant within the vehicle engine cooling system;

a coolant system controller operable under first vehicle operating conditions to turn on the vehicle fan when the coolant temperature reaches a first coolant temperature below a maximum coolant temperature; and the coolant system controller also being operable under second vehicle operating conditions wherein the vehicle is approaching the crest of a hill, to prevent the operation of the vehicle fan even though the coolant temperature has reached or exceeded the first coolant temperature and is below the maximum coolant temperature.

17. A vehicle comprising:

an engine;

a vehicle engine cooling system for receiving and circulating liquid coolant to cool the engine;

a vehicle fan operable to assist the cooling of liquid coolant circulating in the vehicle engine cooling system;

the vehicle engine cooling system comprising a coolant pump operable to circulate liquid coolant within the vehicle engine cooling system;

a coolant system controller operable under first vehicle operating conditions to control the coolant pump to pump coolant at least at a first rate greater than a minimum coolant pumping rate when the coolant temperature reaches a first temperature below a maximum coolant temperature;

the coolant system controller also being operable under second vehicle operating conditions wherein the vehicle is going down a grade, to control the coolant pump to pump coolant at least at the first rate even though the coolant temperature is below the first temperature to provide additional cooling of the coolant fluid prior to climbing a grade.

18. A vehicle according to claim 17, wherein the coolant system controller is also operable under third vehicle operating conditions to turn on the fan and to control the coolant pump to pump coolant at least at the first rate when the coolant temperature reaches a second temperature above the first temperature and below the maximum coolant temperature; and the coolant system controller also being operable under forth vehicle operating conditions wherein the vehicle is going down a grade, to turn on the fan and to control the coolant pump to pump coolant at least at the first rate even though the coolant temperature is below the second temperature.

19. A vehicle comprising:

an engine;

a vehicle engine cooling system for receiving liquid coolant;

a coolant pump for circulating coolant liquid through the vehicle cooling system and engine;

the vehicle engine cooling system comprising a fan selectively operable to cool the coolant liquid circulating through the vehicle cooling system;

an elevation profile determiner operable to determine the presence of an upcoming uphill grade in a section of a route that has yet to be traversed by the vehicle; and a cooling system controller operable to control the cooling system to remove a first quantity of heat from the coolant liquid prior to reaching the upcoming uphill grade, the first quantity of heat being greater than the quantity of heat that is removed by the cooling system in the absence of the upcoming grade.

20. A vehicle comprising:

an engine;

a vehicle engine cooling system for circulating cooling fluid to remove heat from the engine, the vehicle engine cooling system comprising at least a plurality of cooling components;

a cooling system controller operable to determine a desired vehicle engine temperature profile correlated to positions along a section of a route to be traveled by the vehicle;

the cooling system controller also being operable to control the vehicle engine cooling system to cause the temperature of the vehicle engine to match the desired vehicle engine temperature profile when the vehicle travels along the section of the route.

21. A vehicle according to claim 20 wherein the cooling system controller is operable to determine a desired vehicle engine temperature profile based at least in part upon existing vehicle operating conditions and the elevation at various locations along the section of the vehicle route.

22. A vehicle according to claim 20 wherein the controller is operable to determine an engine temperature profile that is at a substantially constant temperature for a given section of the route for which (a) the elevation is unchanged throughout the given section of the route; and (b) the elevation is unchanged in both the section of the route immediately prior to the given section and immediately following the given section.

23. A vehicle according to claim 22 wherein the substantially constant temperature is within about ten degrees C.° of the maximum allowable engine operating temperature.

24. A vehicle according to claim 20 wherein the cooling system controller is operable to determine a desired engine temperature profile based at least in part as a function of engine speed and engine torque.

25. A vehicle according to claim 20 wherein the cooling system controller is operable to determine a desired engine temperature profile based at least in part upon an estimation of the addition of heat to and the removal of heat from cooling fluid in the cooling system arising from heating coolant fluid due to the operation of the engine over the route section and arising from cooling of the cooling fluid by the cooling components.

26. A method according to claim 25 wherein the plurality of cooling components comprise a least a cooling pump and a radiator fan.

27. A method according to claim 26 wherein the plurality of cooling components also comprise a radiator closure mechanism operable to selectively block the delivery of air to a radiator of the cooling system.

28. A method according to claim 20 wherein the cooling system controller is operable to determine a desired engine temperature profile that minimizes at least one cost function.

29. A vehicle comprising:

an engine;

a vehicle engine cooling system for receiving and circulating liquid coolant to cool the engine;

the vehicle engine cooling system comprising at least a first cooling component comprising a vehicle fan operable to assist the cooling of liquid coolant circulating in the vehicle engine cooling system;

the vehicle engine cooling system comprising at least a second cooling component comprising a coolant pump operable to circulate liquid coolant within the cooling system;

the vehicle comprising a receiver operable to receive information indicating the presence of upcoming traffic or road work conditions in a section of a route to be traveled by the vehicle that would result in a need to slow down the vehicle when such traffic conditions or road work conditions are encountered by the vehicle; and a cooling system controller operable to control the cooling components to cause the vehicle engine cooling system to remove a first quantity of heat from the cooling fluid prior to reaching the location of the traffic or road work, the first quantity of heat being greater than the quantity of heat that is removed by the vehicle engine cooling system in the absence of the traffic or road work.

* * * * *

UNITED STATES PATENT AND TRADEMARK OFFICE

CERTIFICATE OF CORRECTION

PATENT NO. : 7,347,168 B2
APPLICATION NO. : 11/513678
DATED : March 25, 2008
INVENTOR(S) : Reckels et al.

It is certified that error appears in the above-identified patent and that said Letters Patent is hereby corrected as shown below:

In the Specification:

Column 21, line 50, "$T_{end}$, $T_{Aux}$", should read --$T_{eng}$, $T_{Aux}$--

Column 22, line 2, "$T_{c,out}^{\bullet}$", should read --$T_{c,}^{\bullet}{}_{out}$--

Column 22, line 34, "($T_{c,out}T_{c,fan}$)", should read --($T_{c,out} - T_{c,fan}$)--

Column 22, line 36, "($T_{c,out}T_{c,max}$)", should read --($T_{c,out} - T_{c,max}$)--

Column 22, line 37, "($T_w T_{w,max}$)", should read --($T_w - T_{w,max}$)--

Column 22, line 55, "$t_{c,out}$", should read --$T_{c,out}$--

Signed and Sealed this
Second Day of April, 2013

Teresa Stanek Rea
*Acting Director of the United States Patent and Trademark Office*